United States Patent [19]

Obata

[11] Patent Number: 4,924,746

[45] Date of Patent: May 15, 1990

[54] INPUT APPARATUS OF ELECTRONIC DEVICE FOR EXTRACTING PITCH FROM INPUT WAVEFORM SIGNAL

[75] Inventor: Katsuhiko Obata, Tokyo, Japan

[73] Assignee: Casio Computer Co., Ltd., Tokyo, Japan

[21] Appl. No.: 282,510

[22] Filed: Dec. 9, 1988

[30] Foreign Application Priority Data

Dec. 28, 1987 [JP] Japan ..... 62-336410

[51] Int. Cl.[5] ..... G10H 7/00; G10H 1/18; G10H 5/00

[52] U.S. Cl. ..... 84/615; 84/616; 84/654; 84/681

[58] Field of Search ..... 84/1.16, 1.01, 1.15, 84/454, 1.14, 615-616, 653-654, 678-681

[56] References Cited

U.S. PATENT DOCUMENTS

| | | | |
|---|---|---|---|
| 3,999,456 | 12/1976 | Tsunoo et al. | 84/681 |
| 4,117,757 | 10/1978 | Akamatu | 84/1.01 |
| 4,151,775 | 5/1979 | Merriman | 84/1.01 |
| 4,198,606 | 4/1980 | Babe | 84/454 X |
| 4,217,808 | 8/1980 | Slepian et al. | 84/454 |
| 4,280,387 | 7/1981 | Moog | 84/681 X |
| 4,300,431 | 11/1981 | DeRocco | 84/1.01 |
| 4,327,623 | 5/1982 | Mochida et al. | 84/616 X |
| 4,351,216 | 9/1982 | Hamm | 84/454 X |
| 4,357,852 | 11/1982 | Suenaga | 84/681 |
| 4,429,609 | 2/1984 | Warrender | 84/454 |
| 4,457,203 | 7/1984 | Schoenberg et al. | 84/454 |
| 4,463,650 | 8/1984 | Rupert | 84/616 X |
| 4,523,506 | 6/1985 | Hollimon | 84/454 |
| 4,606,255 | 8/1986 | Hayashi et al. | 84/1.16 |
| 4,627,323 | 12/1986 | Gold | 84/1.01 |
| 4,633,748 | 1/1987 | Takashima et al. | 84/1.01 |
| 4,658,690 | 4/1987 | Aitken et al. | 84/1.14 |
| 4,688,464 | 8/1987 | Gibson et al. | 84/454 |
| 4,726,275 | 2/1988 | Aitken et al. | 84/1.16 |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-58672 | 12/1982 | Japan . |
| 61-26040 | 2/1986 | Japan . |
| 61-51793 | 11/1986 | Japan . |
| 62-163099 | 7/1987 | Japan . |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

Data representing a pitch is extracted from an input waveform signal and a musical tone having a corresponding tone pitch is generated. By chromatically designating a tone pitch, a musical tone having a tone pitch of a semitone unit is generated from a sound source circuit at the starting of the input waveform signal. After tone generation is started, in the system for updating a tone pitch having an interval of less than a semitone interval, a musical tone is generated in accordance with various performances. Therefore, a musical interval after tone generation is started can be clearly recognized, thus obtaining an excellent musical performance effect.

13 Claims, 19 Drawing Sheets

FIG. 14 (WHEN MT = 1)

FIG. 15 (WHEN MT = 1)

FIG.16 (WHEN MT = 0)

| | TONE PITCH | K | T (μs) | dTm | m |
|---|---|---|---|---|---|
| (22 1Hz) | A3 | 57.0 (=Ko) | 4525 (=To) | | |
| | - | 57.5 | 4396 | 129 | 0 |
| | A# | 58.0 | 4271 | 125 | 1 |
| | - | 58.5 | 4149 | 122 | 2 |
| | B | 59.5 | 4031 | 118 | 3 |
| | - | 59.0 | 3916 | 115 | 4 |
| | C | 60.0 | 3805 | 111 | 5 |
| | - | 60.5 | 3697 | 108 | 6 |
| | C# | 61.0 | 3591 | 106 | 7 |
| | - | 61.5 | 3489 | 102 | 8 |
| | D | 62.0 | 3390 | 99 | 9 |
| | - | 62.5 | 3293 | 97 | 10 |
| | D# | 63.0 | 3200 | 93 | 11 |
| | - | 63.5 | 3108 | 92 | 12 |
| | E | 64.0 | 3020 | 88 | 13 |
| | - | 64.5 | 2934 | 86 | 14 |
| | F# | 65.0 | 2851 | 83 | 15 |
| | - | 65.5 | 2769 | 82 | 16 |
| | F | 66.0 | 2691 | 78 | 17 |
| | - | 66.5 | 2614 | 77 | 18 |
| | G | 67.0 | 2540 | 74 | 19 |
| | - | 67.5 | 2467 | 73 | 20 |
| | G# | 68.0 | 2397 | 70 | 21 |
| | - | 68.5 | 2329 | 68 | 22 |
| | A4 | 69.0 | 2262 (=To/2) | 67 | 23 |

FIG.19

INPUT APPARATUS OF ELECTRONIC DEVICE FOR EXTRACTING PITCH FROM INPUT WAVEFORM SIGNAL

BACKGROUND OF THE INVENTION

1. Field of the Invention

The present invention relates to an apparatus for extracting pitch data from an input waveform signal, and an electronic device for generating a musical tone having a tone pitch corresponding to the extracted pitch data and, more particularly, to an electronic stringed instrument such as an electronic guitar or a guitar synthesizer.

2. Description of the Related Art

Various apparatuses for extracting data representing a pitch (fundamental frequency) from an waveform signal generated in accordance with a human voice or performance of a conventional instrument, and controlling a sound source apparatus constituted by an electronic circuit to artificially obtain sounds such as a musical tone are recently developed.

These techniques are disclosed in the following publications.

USP No. 4,117,757 (issued on Oct. 3, 1978)
Inventor: Akamatsu
USP No. 4,606,255 (issued on Aug. 19, 1986)
Inventors: Hayashi et al.
USP No. 4,633,748 (issued on Jan. 6, 1987)
Inventors: Takashima et al.
USP No. 4,688,464 (issued on Aug. 25, 1987)
Inventors: Gibson et al.
Japanese Patent Publication No. 57-37074 (published on Aug. 7, 1982)
Applicant: Roland K.K.
Japanese Patent Publication No. 57-58672 (published on Dec. 10, 1982)
Applicant: Roland K.K.
Japanese Patent Disclosure (Kokai) No. 55-55398 (disclosed on Apr. 23, 1980)
Applicant: TOSHIBA CORP.
Japanese Patent Disclosure (Kokai) No. 55-87196 (disclosed on July 1, 1980)
Applicant: Nippon Gakki Co., Ltd.
Japanese Patent Disclosure (Kokai) No. 55-159495 (disclosed on Dec. 11, 1980)
Applicant: Nippon Gakki Co., Ltd.
Japanese Utility Model Disclosure (Kokai) No. 55-152597 (disclosed on Nov. 4, 1980)
Applicant: Nippon Gakki Co., Ltd.
Japanese Utility Model Disclosure (Kokai) No. 55-162132 (disclosed on Nov. 20, 1980)
Applicant: Keio Giken Kogyo K.K.
Japanese Patent Publication No. 61-51793 (published on Nov. 10, 1986)
Applicant: Nippon Gakki Co., Ltd.
Japanese Utility Model Publication No. 62-20871 (published on May 27, 1987)
Applicant: Fuji Roland K.K.
Japanese Patent Disclosure (Kokai) No. 61-26090 (published on Feb. 5, 1986)
Applicant: Seiko Denshi Kogyo K.K.
Japanese Patent Disclosure (Kokai) No. 62-163099 (disclosed on July 18, 1987)
Applicant: Fuji Gengakki Seizo K.K.

In addition, Uchiyama et al. filed U.S. patent applications each disclosing a system associated with the present invention (USSN 112,780 on Oct. 22, 1987, and a new U.S. Patent application filed on Oct. 3, 1988).

In such a prior art, in particular, an electronic guitar (guitar synthesizer) with a tremolo arm can extremely change a tone pitch of a string during tone generation.

In electronic instruments of this type, since a tremolo unit is vibrated by picking of the strings, the tone pitch just after picking is unstable. Therefore, after tone generation is started using a first extracted pitch, the tone pitch is undesirably kept continued until the next pitch is extracted. As a result, the tone pitch of the musical tone generated from a sound source is out of tune as compared to an actual acoustic sound.

Therefore, a musical performance discomforts listeners since actual tone pitches are deviated from the designated pitches.

SUMMARY OF THE INVENTION

The present invention has been made on the basis of the above-mentioned background, and has as its object to provide an electronic instrument capable of starting stable tone generation, i.e., tone generation having a certain pitch even if unstable pitch extraction is made at the start of tone generation as described above.

More specifically, according to the present invention, there is provided a tone pitch determining means for chromatically determining a tone pitch of a musical tone output from a sound source means at the start of tone generation, in accordance with data for designating a semitone unit obtained in correspondence with pitch data extracted by a pitch extracting means, when a starting of an input waveform signal is detected by a detecting means.

More specifically, there is provided an input apparatus of an electronic device for extracting pitch data from an input waveform signal by pitch extracting means to determine a tone pitch, comprising detecting means for detecting a starting of the input waveform signal, and tone pitch determining means for chromatically determining the tone pitch in accordance with data which designates a semitone unit obtained in correspondence with the pitch data extracted by the pitch extracting means when the starting of the input waveform signal is detected by the detecting means.

When the pitch extraction is started, therefore, a musical tone is chromatically generated from a sound source means for each semitone (100 cent). For example, from the second time, a frequency having an interval less than the semitone interval (less than 100 cent) is controlled.

BRIEF DESCRIPTION OF THE DRAWINGS

Other objects and features of the present invention will be understood by a person skilled in the art in accordance with the accompanying drawings and a description of the preferred embodiment of the present invention.

FIG. 19 is a pitch data table used for calculation of the tone pitch code according to the flow chart in FIG. 18.

DETAILED DESCRIPTION OF THE PREFERRED EMBODIMENT

An embodiment of the present invention will be described hereinafter with reference to the accompanying drawings. A case where an electronic guitar (guitar synthesizer) which employs the present invention will be described, but note that this invention is not limited thereto and can be similarly applied to electronic instruments of other types.

Figure 1:
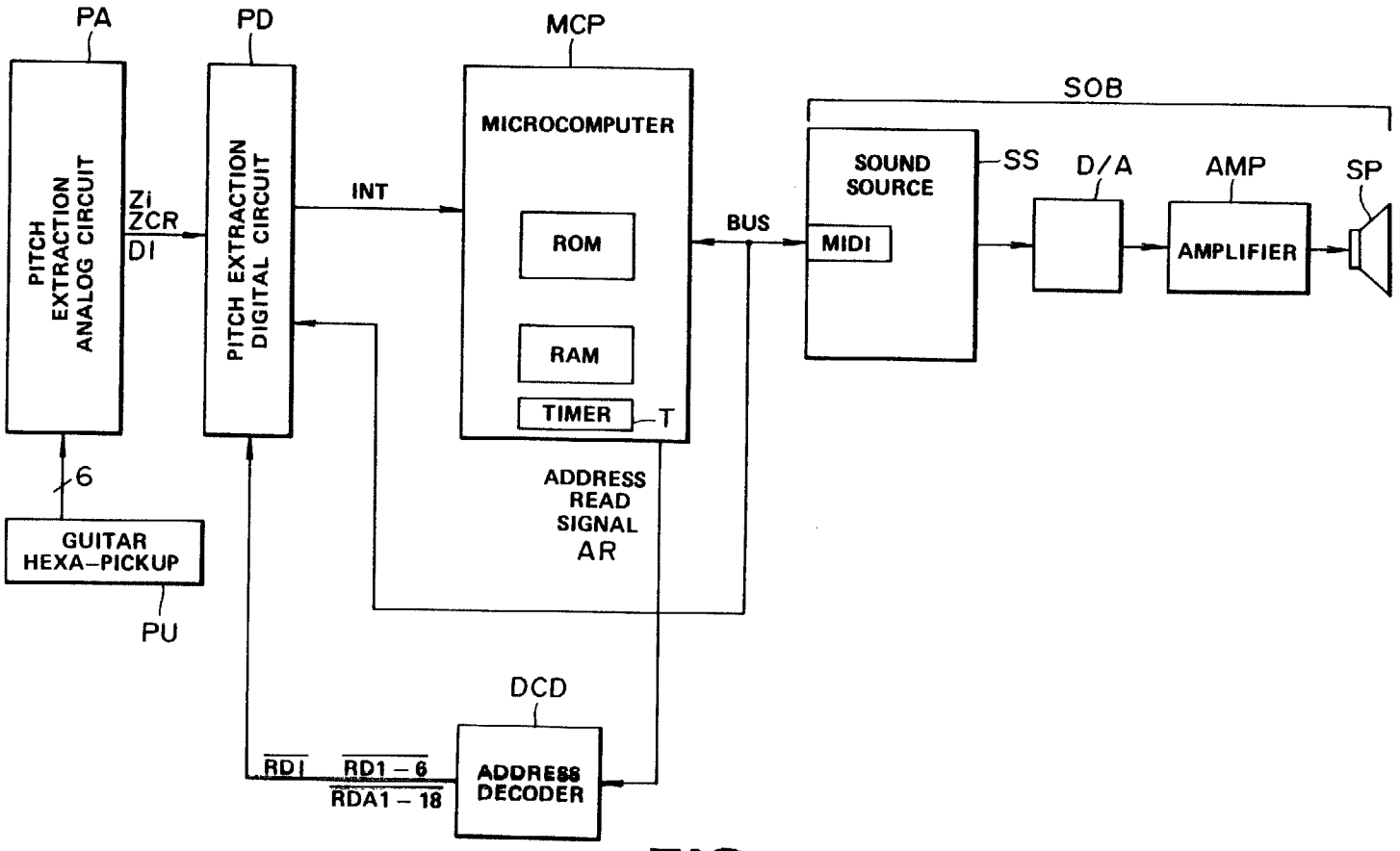
FIG. 1 is a block diagram showing an entire arrangement of an input control apparatus of an electronic instrument according to an embodiment of the present invention.

FIG. 1 is a block diagram showing an entire circuit. Pitch extraction analog circuit PA is arranged e.g., each of six strings stretched on a body of the electronic guitar (not shown). Circuit PA is connected to hexa-pickup PU for converting a vibration of the string into an electrical signal. Circuit PA comprises a converting circuit including analog/digital converter A/D to be described later, for obtaining zero-crossing signals Zi (i=1 to 6) and waveform signals Wi (i=1 to 6) from an output from pickup PU and converting these signals into time-divisional serial zero-crossing signal ZCR and digital output (time-divisional waveform signal) D1.

Figure 2:
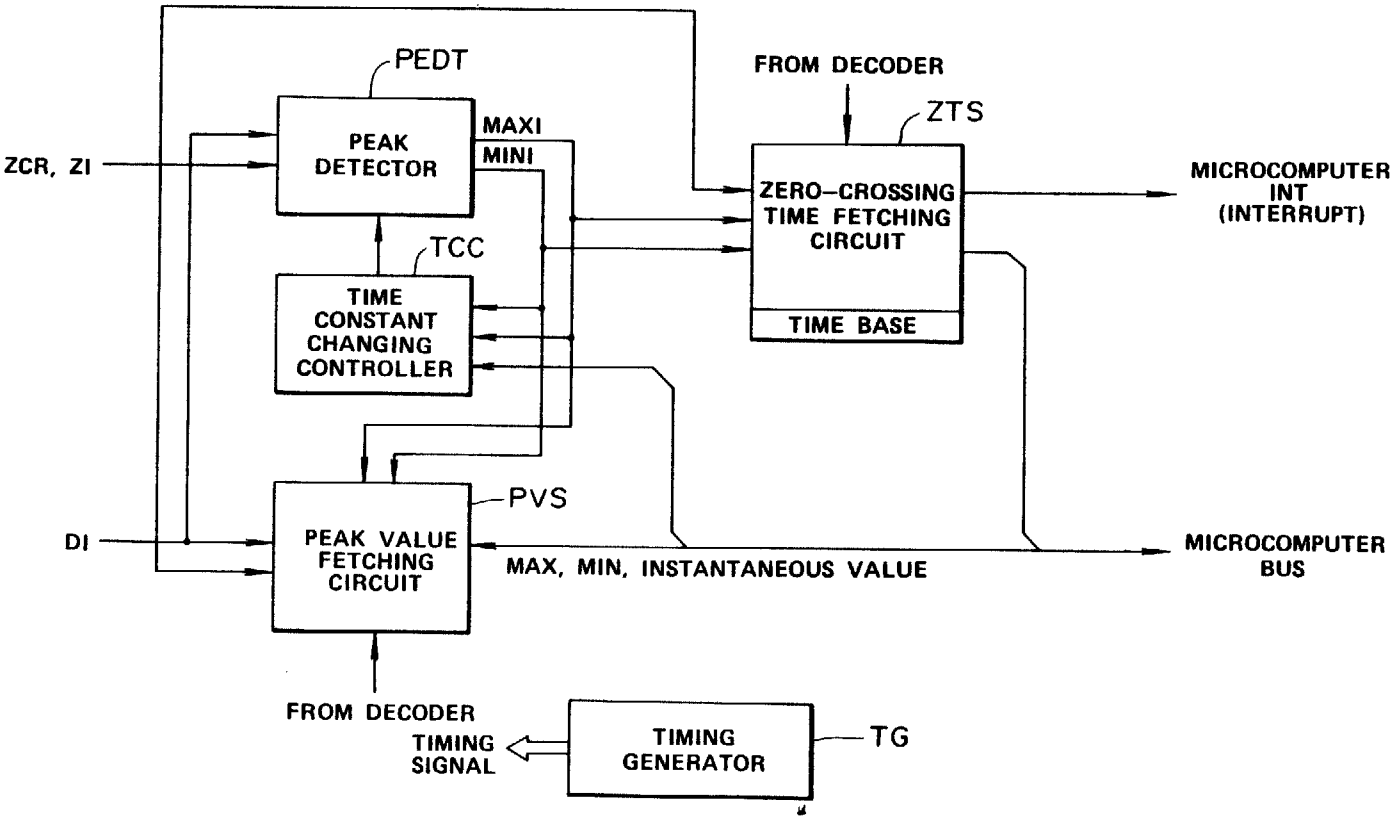
FIG. 2 is a block diagram showing an arrangement of a pitch extraction digital circuit in FIG. 1.

As shown in FIG. 2, pitch extraction digital circuit PD comprises peak detector PEDT, time constant changing controller TCC, peak value fetching circuit PVS, and zero-crossing time fetching circuit ZTS. Circuit PD detects a maximum (a positive) peak point or a minimum (a negative) peak point on the basis of serial zero-crossing signal ZCR and digital output D1 from pitch extraction analog circuit PA, and generates MAXI and MINI (I=1 to 6). In addition, when a zero-crossing point is passed, in a strict sense, when the zero-crossing point is passed immediately after the maximum or minimum peak point, interrupt signal INT from circuit PD is output to microcomputer MCP, and time data at the zero-crossing point and peak value data, e.g. MAX, MIN, and instantaneous values of the input waveform signal, from circuit PD are output to microcomputer MCP. Note that peak detector PEDT includes a circuit for subtracting and holding the past peak values.

Time constant changing controller TCC changes an attenuation factor of the peak hold circuit in peak detector PEDT. When the peak cannot be detected even if, e.g., one period of the waveform has elapsed, the peak value is rapidly attenuated. More specifically, in an initial state, when the maximum tone period has elapsed, the peak value is abruptly attenuated to quickly detect waveform vibrations. When string vibrations are detected, in order not to pickup harmonic overtones, the peak value is abruptly attenuated when an open string period of the string has elapsed. After vibration period of the string is extracted, abrupt attenuation is performed when the extracted period has elapsed.

Microcomputer MCP determines such period data for time constant changing controller TCC. Microcomputer MCP compares contents of counters respectively arranged for strings in time constant changing controller TCC with the determined period data, and a time constant change signal is supplied to peak detector PEDT when the period has elapsed.

Peak value fetching circuit PVS in FIG. 2 demultiplexes waveform signal (digital output) Dl time-divisionally supplied as described above into the peak values of all strings, and the peak values are held in accordance with peak signals MAXI and MINI (I=1 to 6) from peak detector PEDT. Microcomputer MCP outputs a maximum peak value or a minimum peak value of the accessed string to a microcomputer bus through address decoder DCD. The instantaneous values of the vibrations of all strings can be output from peak value fetching circuit PVS.

Zero-crossing time fetching circuit ZTS latches a time base counter output which is common to the strings at a zero-crossing point of each string (strictly, at a zero-crossing point immediately after a maximum peak point or a minimum peak point is passed). The latched time data is supplied to the microcomputer bus in accordance with a request from microcomputer MCP.

Timing generator TG shown in FIG. 2 outputs timing signals for operations of the circuits shown in FIGS. 1 and 2.

Microcomputer MCP comprises a memory including a pitch data table in FIG. 19 (to be described later) such as a ROM and a RAM for various operations, and timer T to control a signal to be supplied to sound source generator SOB. Sound source generator SOB includes sound source SS, digital/analog converter D/A, amplifier AMP, and loudspeaker SP, to produce a musical tone according to note-on (tone generation) signal and note-off (muting) signal from microcomputer MCP, and the pitch of which is corresponding to a tone pitch designation signal for changing a frequency from micro-computer MCP. Note that interface (Musical Instrument Digital Interface) MIDI is arranged between an input side of sound source SS and data bus BUS of microcomputer MCP. When sound source SS is mounted in the body of a guitar, another interface may be arranged. When address read signal AR is input from microcomputer MCP, address decoder DCD outputs string number read-in signal RDI, time read-in signal RDj (j=1 to 6), and read-in signal RDAI (I=1 to 18) for the peak values of the MAX and the MIN and the instantaneous value at every point of the peak to pitch extraction digital circuit PD.

Note that the U.S. Patent application filed on Oct. 3, 1988 by Uchiyama can be applied to the detailed arrangement shown in FIG. 2.

An operation of microcomputer MCP will be described hereinafter with reference to flow and waveform charts. First, reference symbols in the drawings will be described below.

AD . . . an input waveform amplitude value (instantaneous value) obtained by directly reading an input waveform of pitch extraction digital circuit PD in response to instantaneous value read-in signals RDA13 to RDA18 in FIG. 1

AMP (0, 1) . . . a positive or negative immediately preceding (old) peak value

AMRL1 . . . an immediately preceding amplitude value for check of "relative-off" stored in an amplitude register. In this case, the "relative-off" represents muting on the basis of abrupt attenuation of the peak value, and corresponds to muting processing when a fret operation is stopped and changed to an open-string state.

AMRL2 . . . the second preceding amplitude value for the "relative-off" stored in the amplitude register, and the value of AMRL1 is input therein.

CHTIM . . . a period corresponding to a maximum tone fret (e.g., 22nd fret)

CHTIO . . . a period corresponding to an open string fret

CHTRR . . . a time constant changing register arranged in the above-described time constant changing controller TCC (FIG. 2)

DUB . . . a flag representing identical polarity repetition of waveforms

FOFR . . . a relative-off counter

HNC . . . an waveform number counter

K . . . tone pitch data consisting of a tone pitch code having a semitone interval or more and a tone pitch code having an interval less than a semitone interval MT . . . a flag representing a side on which pitch extraction will be performed (positive=1, negative=0)

NCHLV . . . a no-change level (constant)

OFTIM . . . off time (e.g., corresponding to an open string period of the string)

OFPT . . . a normal-off check start flag

ONF . . . a note-off flag

RIV . . . a flag for switching a processing route in STEP4 (to be described later)

ROFCT . . . a constant for determining the number of relative-off check cycles

STEP . . . registers (1 to 5) for designating a flow operation of microcomputer MCP T . . . period data TF . . . effective preceding zero-crossing time data TFN (0, 1) . . . preceding zero-crossing time data immediately after positive or negative peak point TFR . . . a time memory register THLIM . . . a frequency upper limit (constant)

TLLIM . . . a frequency lower limit (constant)

TP (0, 1) . . . positive or negative preceding period data

TRLAB (0, 1) . . . a positive or negative absolute trigger level (note-on threshold value)

TRLRL . . . relative-on (restart of tone generation)

TRLRS . . . a resonance elimination threshold value

TTLIM . . . a frequency lower limit during triggering

TTP . . . preceding extracted period data

TTR . . . a period register

TTU . . . a constant (product of 17/32 and current period data tt)

TTW . . . a constant (product of 31/16 and current period data tt)

VEL . . . data for setting velocity which is determined in accordance with a maximum peak value of a waveform when tone generation is started X . . . a flag representing an abnormal or normal state b . . . current positive/negative flag stored in working register B ("1" at a zero point succeeding a positive peak, and "0" at a zero point succeeding a negative peak)

c . . . a current peak value stored in working register C e . . . the second preceding peak value stored in working register E h . . . the second preceding extracted period data stored in working register H t . . . current zero-crossing time stored in working register T0 tt . . . current period data stored in working register TOTO

Figure 3:
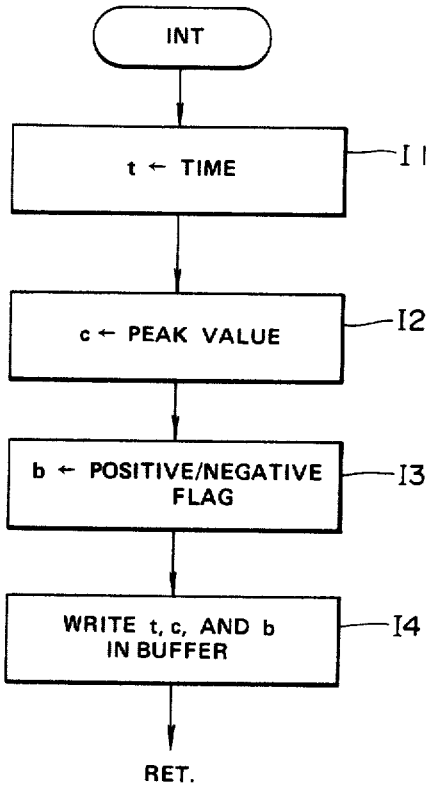
FIG. 3 is a flow chart showing an interrupt processing routine of a microcomputer in FIG. 1.

FIG. 3 is a flow chart of an interrupt routine showing processing when microcomputer MCP is interrupted. In step I1, microcomputer MCP supplies string number read-in signal RDI to zero-crossing time fetching circuit ZTS through address decoder DCD to read the string number for designating a string which interrupts the microcomputer MCP. Time data corresponding to the string number, i.e., zero-crossing time data is read by supplying the corresponding one of time read-in signals RD1 to RD6 to zero-crossing time fetching circuit ZTS. This zero-crossing time is represented by "t". Thereafter, in step I2, peak value read-in signal RDAI (I=one of 1 to 12) is similarly supplied to peak value fetching circuit PVS to read the peak value. This peak value is represented by "c".

In succeeding step I3, data b representing positive or negative peak is obtained from zero-crossing time fetching circuit ZTS. In step I4, values t, c, and b thus obtained are written in registers T0, C, and B of the buffer in microcomputer MCP, respectively. Such time data, peak value data, and data representing types of peak are written as one set in this buffer every interrupt operation. In a main routine, operations for these data are performed in units of strings.

Figure 4:
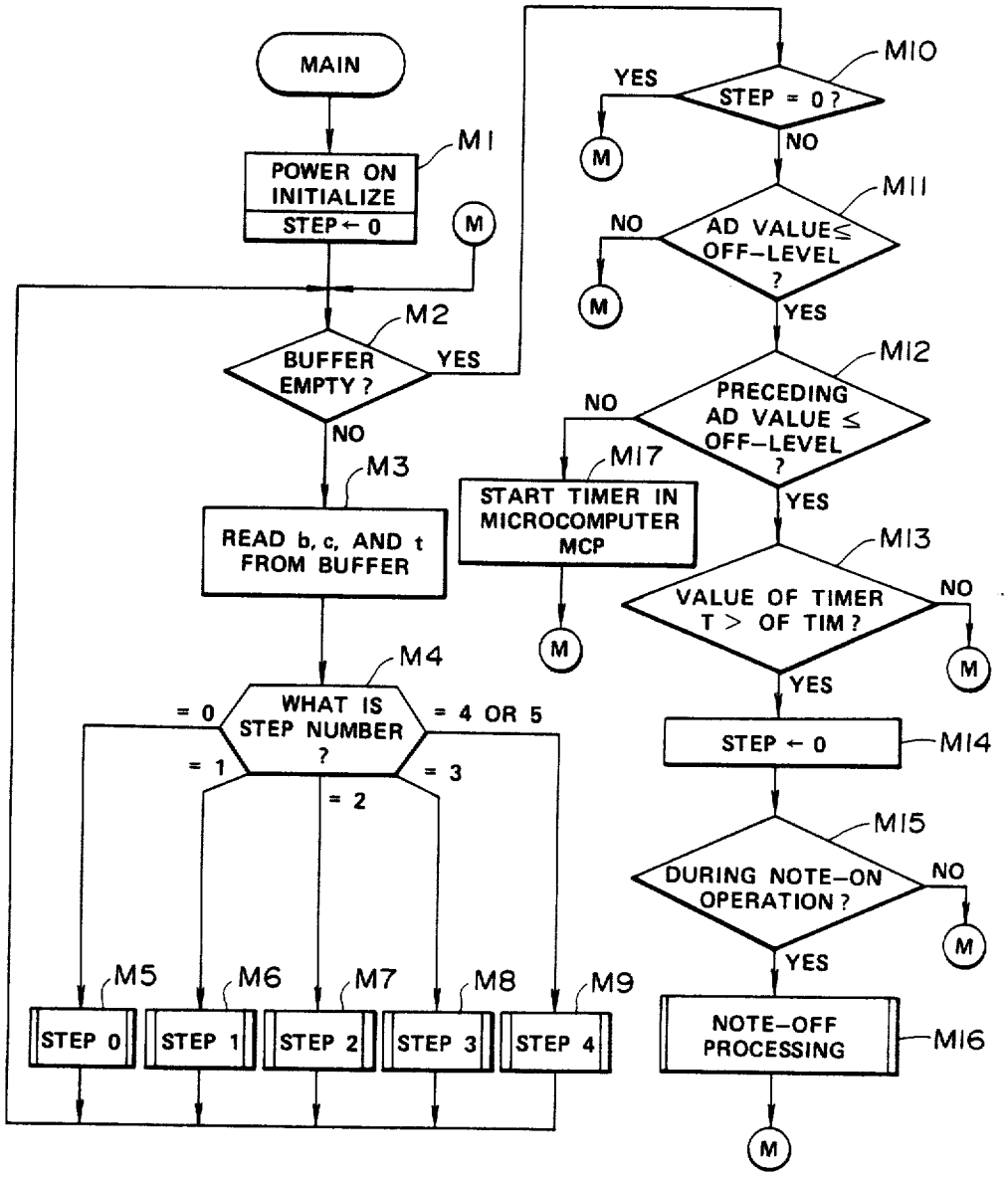
FIG. 4 is a flow chart showing a main processing routine of the microcomputer in FIG. 1.

FIG. 4 is a flow chart showing the main routine. In step M1, a power-on operation is performed to initialize various registers and flags and to set register STEP to be 0. It is determined in step M2 whether the above-mentioned buffer is empty or not. If NO in step M2, the flow advances to step M3, and the contents of registers B, C, and T0 are read. Therefore, the content of register STEP is determined in step M4. If the content of register STEP is 0, subroutine STEP0 is executed in step M5; if 1, STEP1 in step M6; if 2, STEP2 in step M7; if 3, STEP3 in step M8; and if 4 or 5, STEP4 in step M9.

If the buffer is empty in step M2, i.e., if YES in step M2, the flow sequentially advances to step M10 through step M16. In these steps, normal note-off processing is performed. In this note-off processing, if the state where an AD value is an OFF level or less continues for a predetermined off-time, note-off processing is executed. It is determined in step M10 if STEP=0. If NO in step M10, the flow advances to step M11. In step M11, input peak value AD at this time is directly read. By supplying one of peak value read-in signals RDA13 to RDA18 to peak value fetching circuit PVS, this operation in step M11 can be achieved. It is determined in step M11 if input peak value AD≦off level. If YES in step M11, the flow advances to step M12. In step M12, it is determined if preceding input peak value AD≦off level. If YES in step M12, the flow advances to step M13. In step M13, it is determined if the value of timer T≧off time OFTIM (e.g., constant of an open string period of the corresponding string). If YES in step M13, the flow advances to step M14, and 0 is written in register STEP. It is determined in step M15 if note-on processing is executed. If YES in step M15, note-off processing is performed in step M16 and the flow returns to step M2. If NO in step M12, the flow advances to step M17. Timer T in microcomputer MCP is started and the flow returns to step M2. If YES in step M10, and if NO in steps M11, M13, and M15, the flow returns to step M2.

When the waveform input level is thus attenuated, input peak value AD the level of which is an off level or less is kept for time corresponding to off time OFTIM, so that microcomputer MCP supplies a note-off instruction to sound source SS. In step M15, YES is obtained in a normal state. However, by operations to be described later, even if generation of a musical tone is not designated, register STEP is often set to be a value other than 0 (e.g., by a noise input). In this case, the flow returns to step M2 after operations in steps M14 and M15, so that initializing can be performed.

Although processing for one string is shown in FIG. 4, microcomputer MCP multiplexes and executes the processing in FIG. 4 for six times corresponding to the number of strings. A plurality of processors may be arranged to separately execute the same processing.

Each routine branched from step M4 to execute corresponding processing will be described below in detail.

Figure 5:
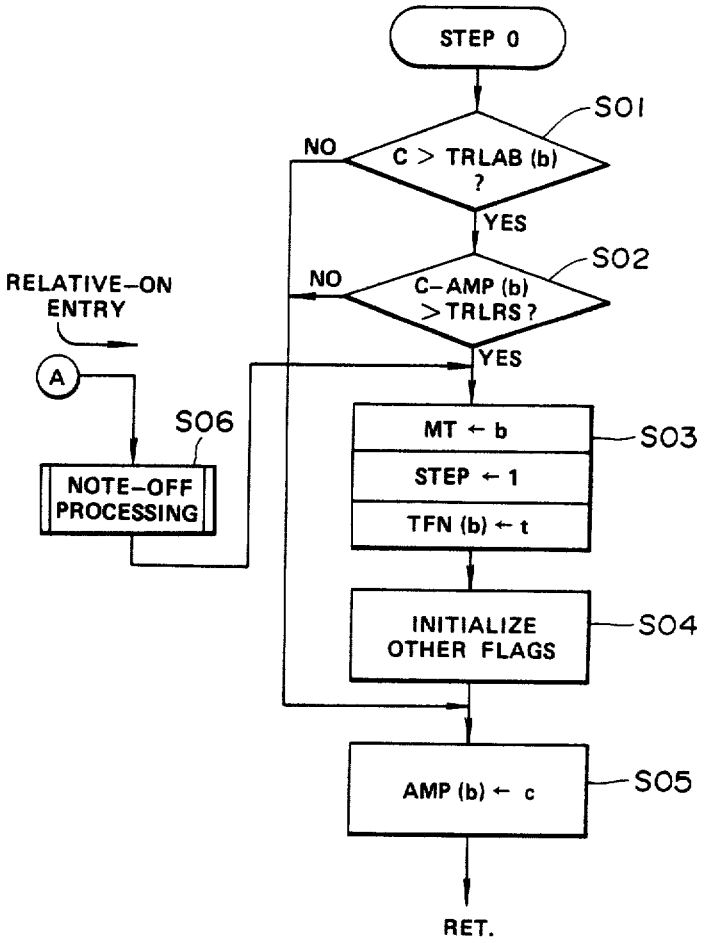
FIG. 5 is a flow chart showing subroutine STEP0 corresponding to processing in step M5 of the main routine in FIG. 4.

FIG. 5 is a flow chart in STEP0 representing step M5 in FIG. 4. It is determined in step S01 if absolute trigger level (note-on threshold value) TRLAB (b)<current peak value c. If YES in step S01, the flow advances to step S02 and resonance elimination is checked. This trigger level for peaks having positive and negative polarities are checked. TRLAB (0) and TRLAB (1) are set to be appropriate values by an experiment or the like. In an ideal system, TRLAB (0) may be equal to TRLAB (1). It is determined in step S02 if resonance elimination threshold value TRLRS<[current peak value c—preceding peak value AMP (b)], i.e., if the difference between the current and preceding peak values is the predetermined value or more.

When one string is picked so that other strings are resonated, the vibration levels of the other strings are gradually increased. As a result, a change from the preceding peak value to the current peak value is very small, and a difference therebetween does not exceed resonance elimination threshold value TRLRS. However, in normal picking, an waveform is abruptly raised (or fallen) so that the difference between the above two peak values exceeds resonance elimination threshold value TRLRS.

If YES in step S02, i.e., it is determined that resonance does not occur, the following processing is executed in step S03. That is, current positive/negative flag b is written in flag register MT, and 1 is written in register STEP. In addition, current zero-crossing time t is set as preceding zero-crossing time data TFN (b). The other flags are initialized in step S04, and the flow advances to step S05. In step S05, current peak value c is set as preceding peak value AMP (b), and thereafter the flow returns to the main flow in FIG. 4.

In FIG. 5, reference symbol A represents a "relative-on" (restart of tone generation) entry. The flow jumps to this step S06 from a flow of STEP4 to be described later. In step S06, the musical tone which has been produced is temporarily muted, and the flow advances to step S03 in order to restart tone generation. This processing for restarting tone generation is performed in the same manner as in normal tone generation, and a description thereof will be described later.

If NO in steps S01 or S02 (if current peak value c - preceding peak value AMP (b) is a predetermined value or less), the flow advances to step S05. Therefore, processing for tone generation is not executed.

In above-mentioned STEP0 (flow from STEP0 to STEP1 in FIG. 11), the content of register B (b=1) is written in flag register MT, content (t) of register T0 is set as preceding zero-crossing time data TFN (1), and peak value (c) of register C is set as preceding peak value AMP (1).

Figure 6:
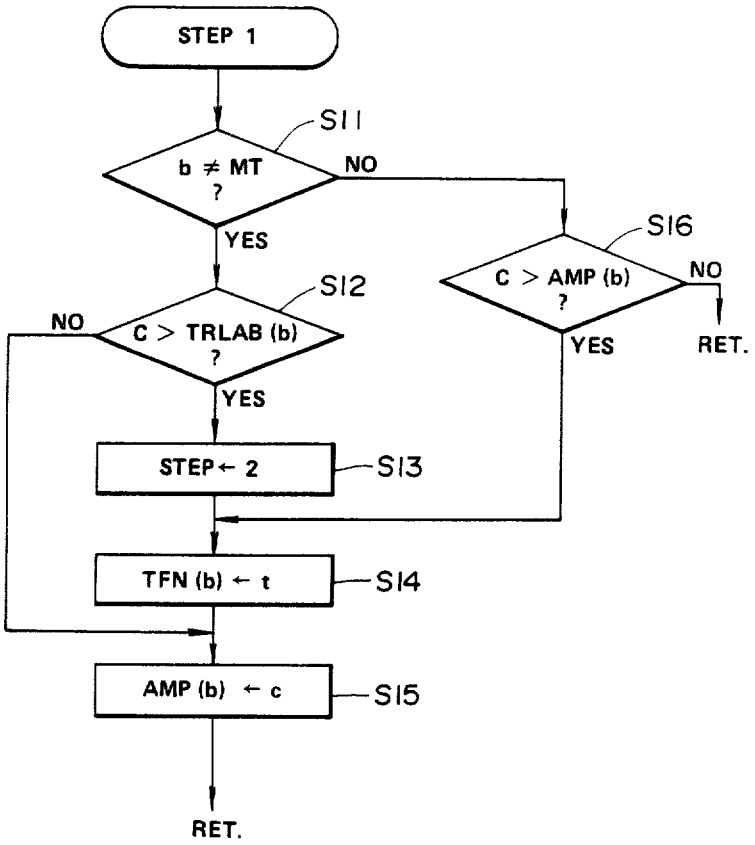
FIG. 6 is a flow chart showing subroutine STEP1 corresponding to processing in step M6 of the main routine in FIG. 4.

FIG. 6 is a flow chart showing subroutine STEP1 represented as step M6 in FIG. 4. It is determined in step S11 if content (b) of register B coincides with flag MT. If YES in step S11, the flow advances to step S12. It is determined in step S12 if absolute trigger level (note-on threshold value) TRLAB (b)<current peak value c. If YES in step S12, the flow advances to step S13. If YES in step S12, 2 is written in register STEP. In step S14, content (t) of register T0 is set as preceding zero-crossing time data TFN (b). In addition, current peak value c is set as preceding peak value AMP (b) in step S15. If NO in step S11, i.e., input waveform signals have identical polarity, the flow advances to step S16. It is determined in step S16 if current peak value c>preceding peak value AMP (b). If YES in step S16, i.e., current peak value c is larger than preceding peak value AMP (b), the flow advances to step S14. On the contrary, if NO in step S12, the flow advances to step S15, thereby updating only the peak value. If NO in step S16, or when the processing in step S15 is completed, the flow returns to the main routine (FIG. 4).

In the above-mentioned STEP1 (flow from STEP1 to STEP2 in FIG. 11), it is determined that current positive/negative flag b (=0) does not coincide with flag MT (=1), and current zero-crossing time t is set as preceding zero-crossing time data TFN (0). In addition, current peak value c is set as preceding peak value AMP (0).

Figure 7:
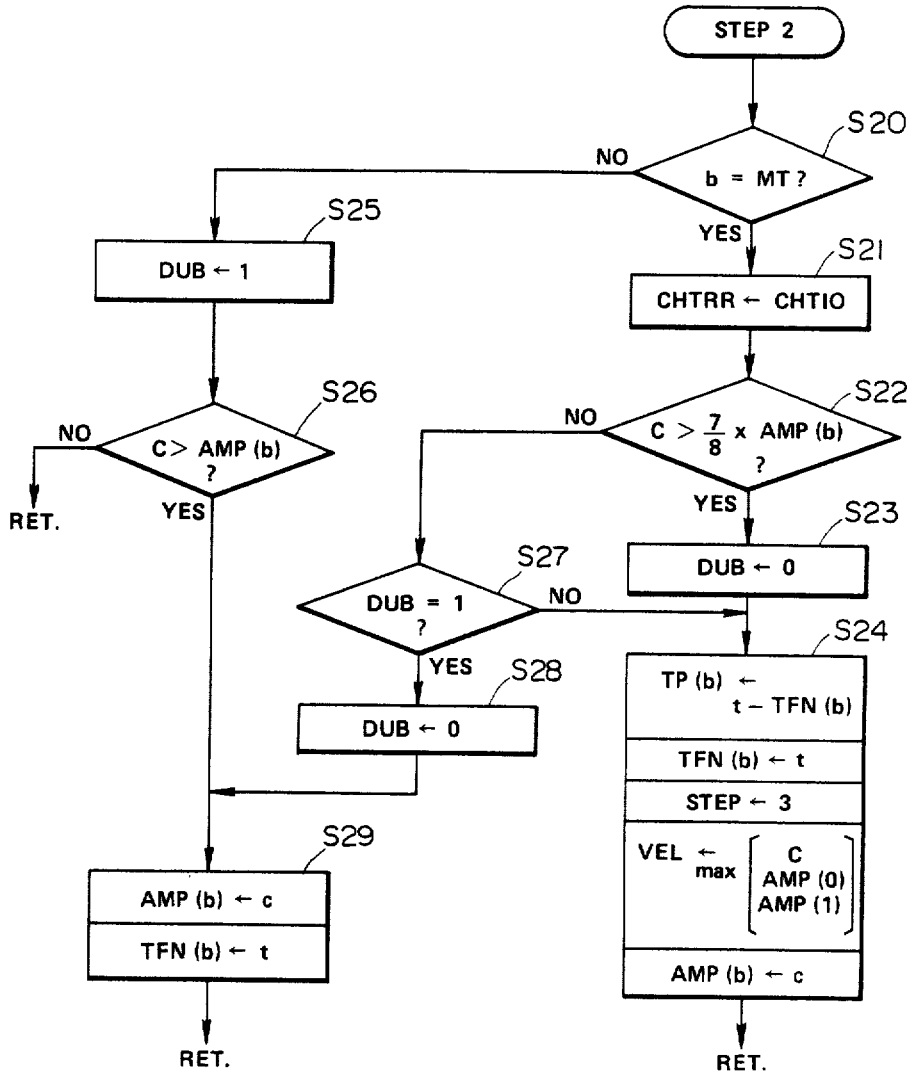
FIG. 7 is a flow chart showing subroutine STEP2 corresponding to processing in step M7 of the main routine in FIG. 4.

FIG. 7 is a flow chart showing subroutine STEP2 represented as step M7 of the main routine in FIG. 4. It is determined in step S20 if current positive/negative flag b=flag MT, i.e., if a zero-crossing point succeeding a peak value having identical polarity as in STEP0. If YES in step S20, the flow advances to step S21. In step S21, open string period CHTIO is set in register CHTRR in time constant changing controller TCC in FIG. 2, and the flow advances to step S22. It is checked in step S22 if current peak value $c > (\frac{7}{8}) \times$ (preceding peak value AMP (b)), i.e., the preceding peak value is substantially equal to the current peak value. If YES in step S22, i.e., if the peak value is smoothly and naturally attenuated, the flow advances to step S23. Flag DUB is set to be 0 and the flow advances to step S24. In step S24, period calculation is performed, (current zero-crossing time t—preceding zero-crossing time data TFN (b)) is set as preceding period data TP (b), and current zero-crossing time t is input as preceding zero-crossing time data TFN (b). TP (b) in step S24 is used as a note-on condition (1.5 waves) in STEP3. In step S24, register STEP is set to be 3. In addition, of current peak value c, preceding peak value AMP (0), and preceding peak value AMP (1), the largest value is stored as velocity VEL. Current peak value c is set as preceding peak value AMP (b).

If NO in step S20, the flow advances to step S25. Flag DUB, i.e., a flag representing that the input waveform having the identical polarity appears is set to be 1, and the flow advances to step S26. It is determined in step S26 if current peak value c > preceding peak value AMP (b). If YES in step S26, the flow advances to step S29. In step S29, preceding peak value AMP (b) is updated to current peak value c, and preceding zero-crossing time data TFN (b) is also updated to content t of register T. If NO in step S22, the flow advances to step S27. It is checked in step S27 if flag DUB = 1, i.e., the waveforms have an identical polarity when STEP2 is executed in the preceding cycle. If YES in step S27, i.e., the waveforms have an identical polarity, the flow advances to step S28. In step S28, flag DUB is set to be 0. In this case, the flow advances to step S29 and returns to the main routine. After the processing in step S24, or if NO in step S26, the flow similarly returns to the main routine (RET).

In the above-mentioned STEP2 (flow from STEP2 to STEP 3 in FIG. 11), flag MT = 1 is updated as current positive/negative flag b, and a zero fret period, i.e., open string period CHTIO is updated in register CHTRR. Flag DUB is set to be 0, and period calculation (t − TFN (1)) → TP (1) is performed. Preceding zero-crossing time data TFN (1) is updated to current zero-crossing time t. Of current peak value c, preceding peak value AMP (0), and preceding peak value AMP (1), the largest value is set as velocity VEL, and preceding peak value AMP (1) is set as current peak value c.

Figures 8A, 8B:
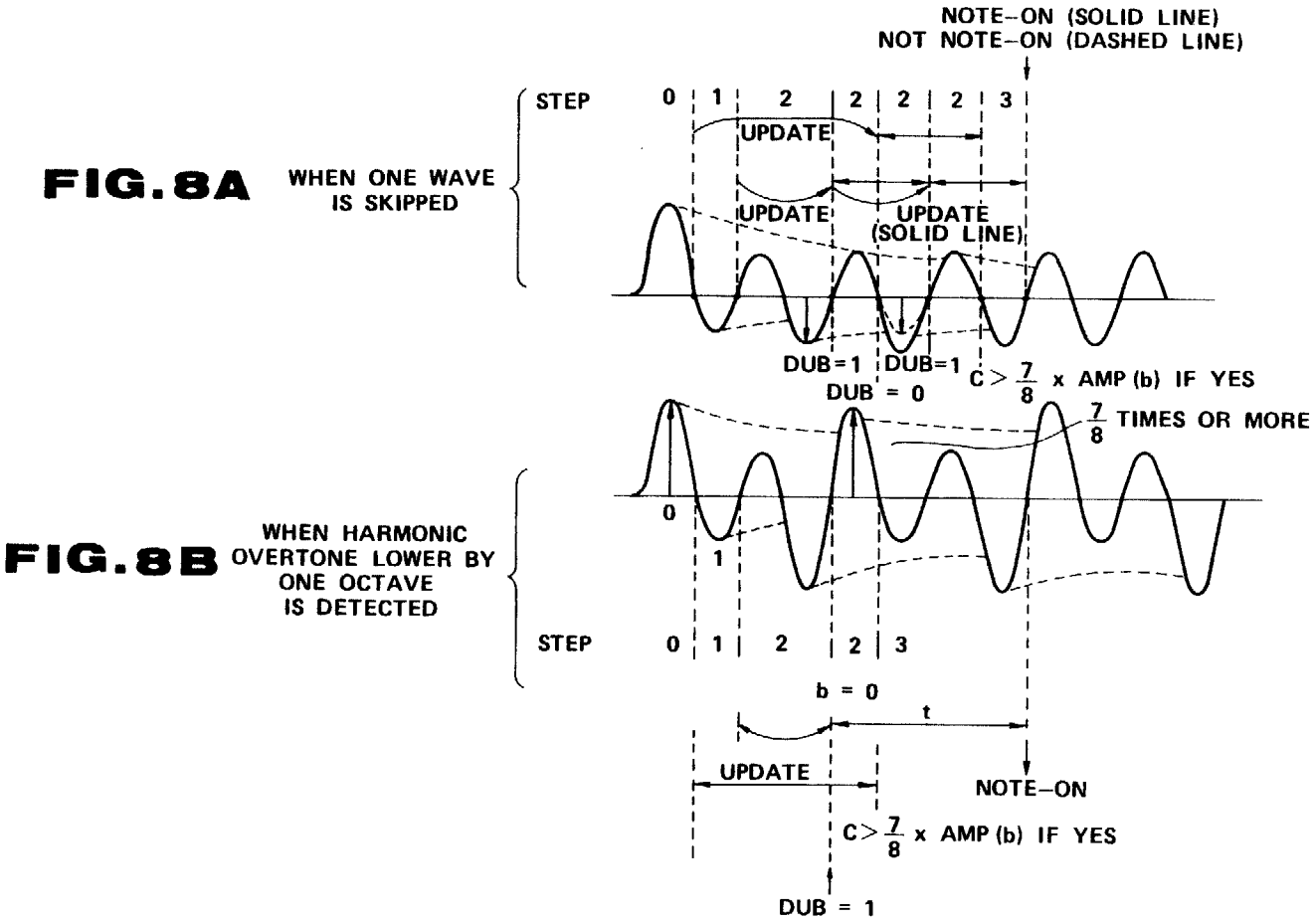
FIGS. 8A and 8B are timing charts showing operations from STEP0 to STEP3 when an irregular vibration waveform is input.
Figure 11:
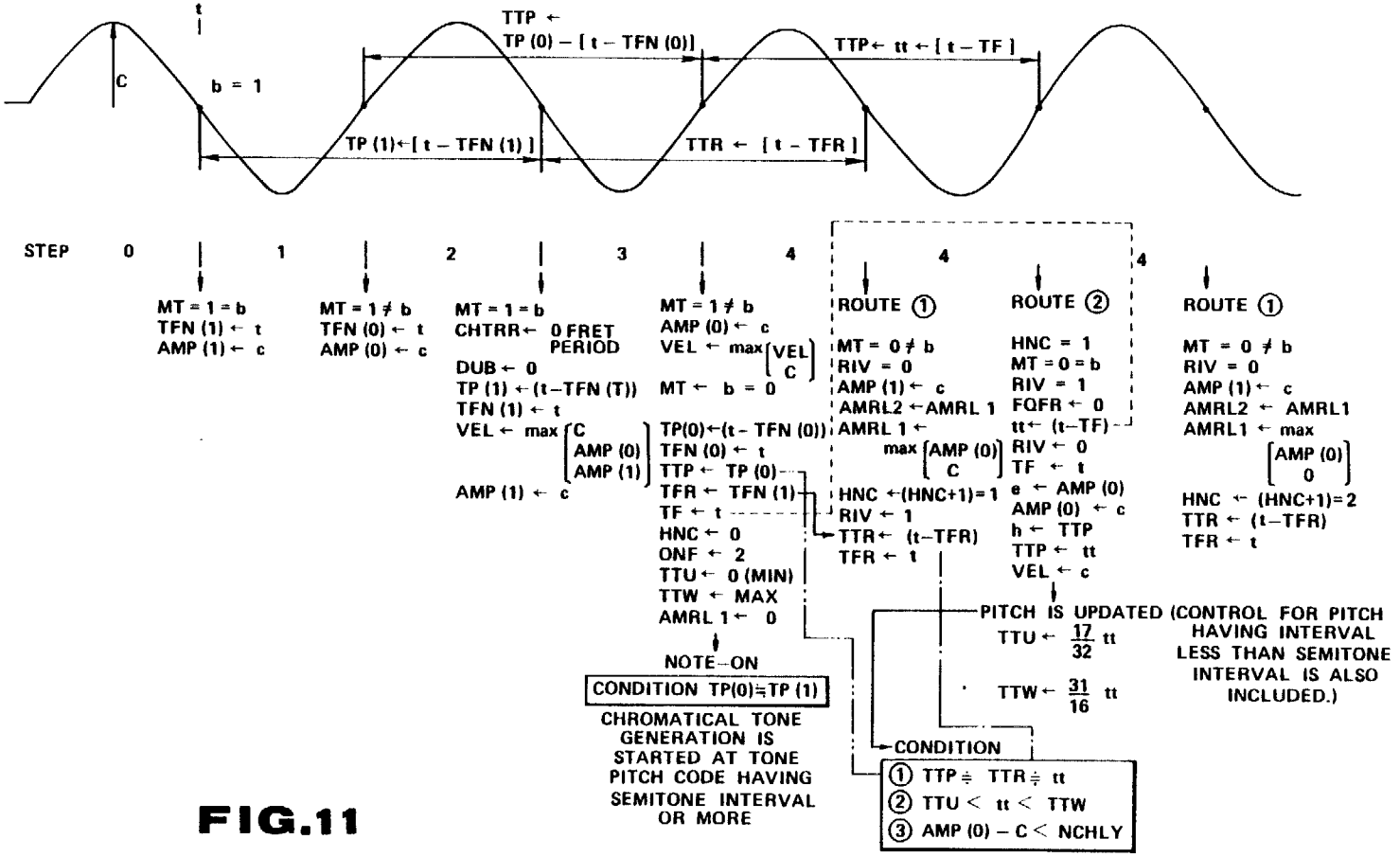
FIG. 11 is a timing chart showing operations from STEP0 to STEP4 when an ideal vibration waveform is input.

FIG. 11 is a timing chart when an ideal waveform signal is input. The case where DUB = 1 will be described below. FIGS. 8A and 8B are timing charts for explaining an operation in STEP2 in the above case. In FIG. 8A, one wave is skipped to detect the peak. When the input waveform is indicated by a solid line, note-on processing is performed by operations in STEP3 to be described later. When the input waveform is indicated by a dotted line, note-on processing is not performed. This difference in FIG. 8A is caused by a difference between the YES and the NO in step S26. The flow does not smoothly advance from STEP2 to STEP3 because it is determined if $c > (\frac{7}{8}) \times$ AMP (b) and NO in step S22, and STEP2 is repeatedly executed until YES is obtained in step S22, even if b = MT in step S20. In FIG. 8B, a harmonic overtone lower by one octave is detected. In this case, it is determined that $c > (\frac{7}{8}) \times$ AMP (b) and YES is obtained, so that the flow advances to step S24 through step S23, and advances to STEP3.

Figure 9:
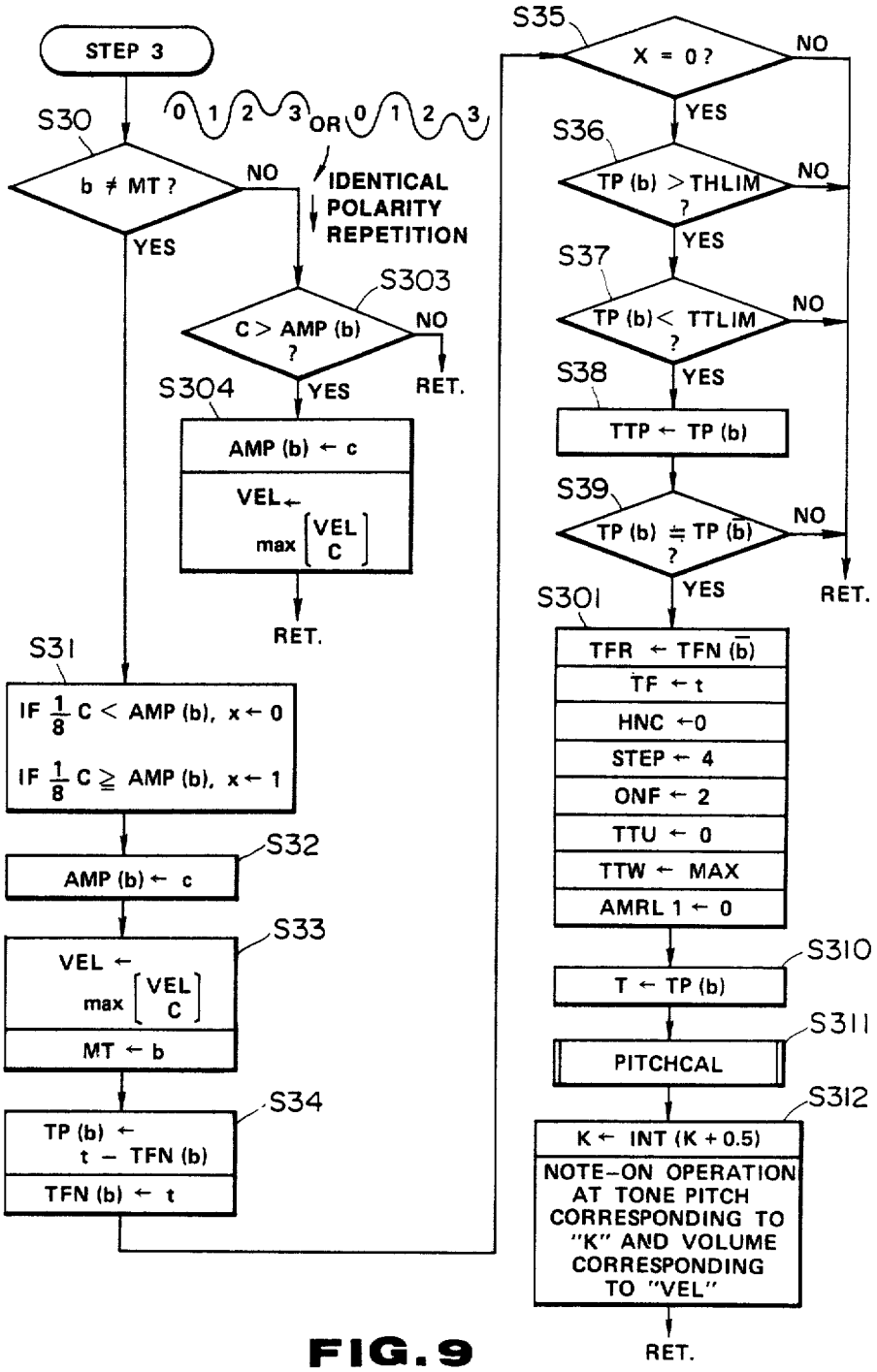
FIG. 9 is a flow chart showing subroutine STEP3 corresponding to processing in step M8 of the main routine in FIG. 4.

FIG. 9 is a flow chart showing STEP3 represented as step M8 in FIG. 4. It is determined in step S30 if flag MT ≠ current positive/negative flag b. In a normal case, i.e., YES in step S30, the flow advances to step S31. In step S31, if $(\frac{1}{8})c <$ AMP (b), X is set to be 0. If $(\frac{1}{8})c \geqq$ AMP (b), X is set to be 1, and the flow advances to step S32. In step S32, preceding peak value AMP (b) is updated as current peak value c.

In step S33, if current peak value c is larger than VEL obtained in STEP2, current peak value c is input as velocity VEL. If current peak value c is smaller than VEL, this velocity is not changed. Then, flag MT is updated as current positive/negative flag b, and therefore a pitch changing side is reversed. Therefore, the meaning of flag MT is changed from STEP4 to be described later, and flag MT represents the pitch changing side. In step S34, period calculation [(t − TFN (b)) → TP (b)] is performed. Preceding zero-crossing time data TFN (b) is updated to current zero-crossing time t.

It is determined in step S35 if X = 0. If YES in step S35, the flow advances to step S36. It is checked in step S36 if frequency upper limit THLIM < preceding period data TP (b), i.e., the pitch extraction upper limit is checked. As a result, if the period is longer than the maximum tone period, YES is obtained in step S36 because the limit is within the allowable limit. Then, the flow advances to step S37. It is checked in step S37 if frequency lower limit during triggering TTLIM > preceding period data TP (b), i.e., the pitch extraction lower limit is checked. If the period is shorter than the minimum tone period, the period is within the allowable limit. Therefore, YES in step S37 and the flow advances to step S38. The constant of the pitch extraction lower limit in step S37 is different from that of the pitch extraction lower limit in STEP4 to be described later.

More specifically, frequency upper limit THLIM corresponds to a tone pitch period of a fret higher than a fret of the maximum tone by two to three semitones. Frequency lower limit TTLIM during triggering corresponds to a tone pitch period of a fret lower than a fret of an open string fret by five semitones.

In step S38, preceding period data TP (b) is set as previously extracted period data TTP, i.e., a pitch extracted at the pitch extraction side, is saved (used in STEP4 to be described later), and the flow advances to step S39. It is checked in step S39 if preceding period data TP(b) ≈ TP ($\bar{b}$), i.e., 1.5-wave pitch extraction is performed to check if the periods between zero-crossing points having different polarities substantially coincide with each other. If YES in step S39, the following operations are performed in step S301. That is, preceding zero-crossing time data TFN ($\bar{b}$) is set in time memory register TFR, current zero-crossing time t is set as preceding zero-crossing time data TF, and waveform number counter HNC is cleared. This counter HNC is used in STEP4 to be described later. Register STEP is set to be 4, note-on flag ONF is set to be 2 (tone generation state), constant TTU is set to be 0, i.e., (MIN), and constant TTW is set to be maximum value MAX. These are used in STEP4 to be described later. In addition, preceding peak value register AMRL1 is cleared to perform the relative-off operation.

In step S310, period data TP (b) thus obtained is input to register T. In step S311, the flow jumps to subroutine (PITCHCAL) for obtaining tone pitch code K. By using a tone pitch code to be obtained, an instruction for starting tone generation is output to sound source SS in step S312. At this time, a tone pitch code having an interval less than a semitone interval (less than 100 cent) is rounded (K←INT (K+0.5)). Therefore, the start of tone generation of a chromatic tone pitch is designated to sound source SS. The volume of musical tone generation is determined in accordance with the value of the velocity stored in register VEL.

Figure 18:
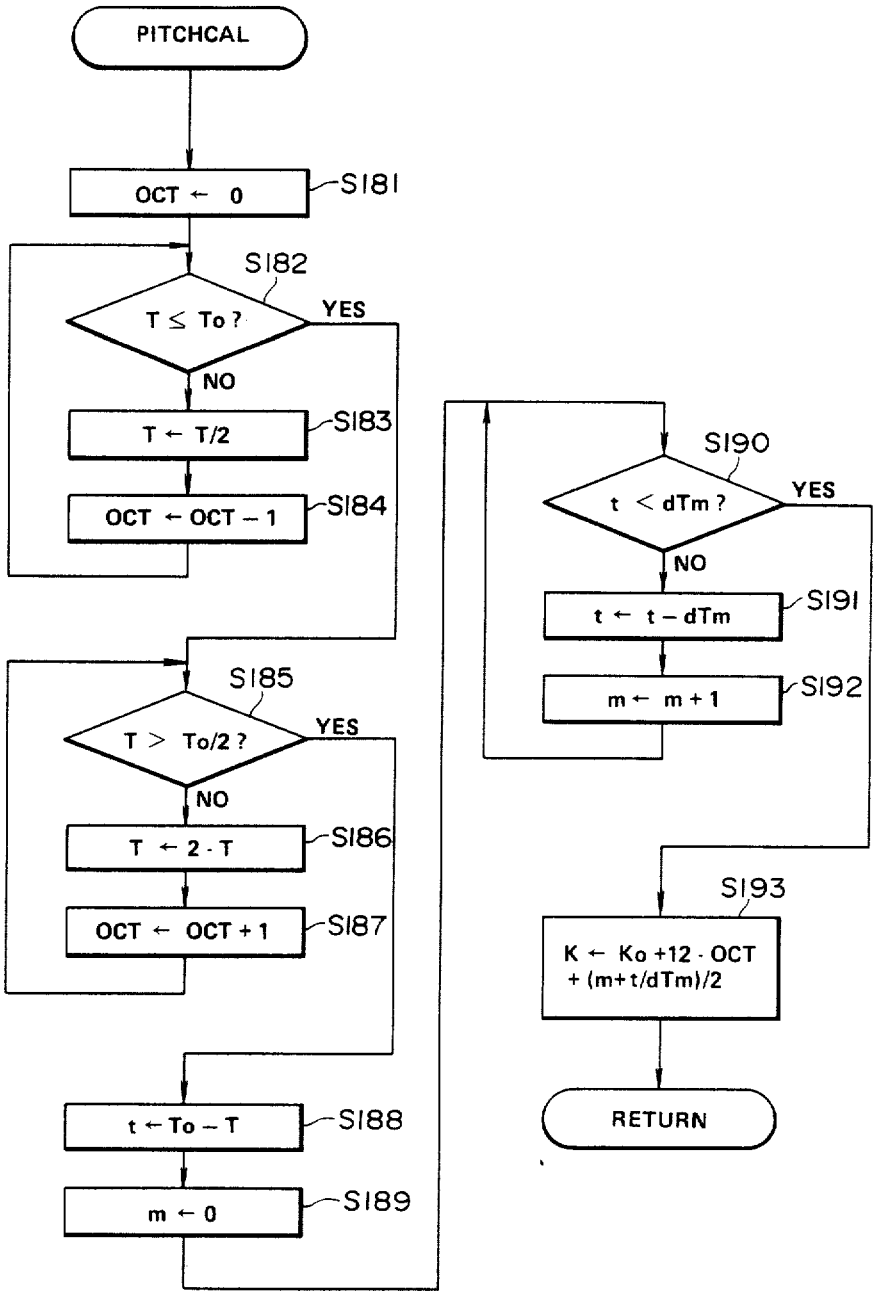
FIG. 18 is a flow chart showing in detail PITCAL in step S311 which is a subroutine for obtaining a tone pitch code in the flow chart of STEP3 in FIG. 9.

FIG. 18 is a flow chart showing the subroutine in step S311 in detail.

Microcomputer MCP sets octave value OCT to be 0 (S181) and determines whether extracted pitch data T is smaller than reference pitch data T0 "4525" in a pitch data table (FIG. 19) stored in microcomputer MCP (S182). If extracted pitch data T is, e.g., "9800", since this data T "9800" is larger than reference pitch data T0 "4525", the flow advances to step S183. Extracted pitch data T "9800" is divided by two to obtain "4900", and octave value OCT is decremented by 1 to obtain "−1" (S184). Then, the flow returns to step S182 again, and it is determined in step S182 whether half extracted pitch data T "4900" is smaller than reference pitch data T0 "4525".

Since extracted pitch data T "4900" is still larger than reference pitch data T0, operations in steps S183 and S184 are repeated and extracted pitch data T "4900" is divided by two to obtain "2450", and the octave value is decremented by 1 to obtain "−2". Microcomputer MCP similarly determines whether extracted pitch data T "2450" is smaller than reference pitch data T0 "4525" (S182).

In this case, since extracted pitch data T "2450" is smaller than reference pitch data T0, the flow advances to step S185. Microcomputer MCP determines whether extracted pitch data T "2450" is larger than half reference pitch data T0 "2262.5". Since extracted pitch data T "2450" is larger than half reference pitch data T0 "2262.5", the flow advances to step S188. Extracted pitch data T "2450" is subtracted from reference pitch data T0 "4525" to obtain fraction data t "2075" which represents an interval smaller than an octave, and order data m is set to be "0" (S189). It is determined if fraction data t "2075" is smaller than difference pitch data dTm "129" corresponding to order data m "0" (S190).

Since difference pitch data dTm is smaller than fraction data t "2075", the flow advances to step S191. First difference pitch data dTm "129" is subtracted from fraction data t "2075" to obtain "1946". Order data m is incremented by one to update order data m to "1" (S192). Operations in steps S191 and S192 are repeated until fraction data t is smaller than difference pitch data dTm, and difference pitch data dTm is sequentially subtracted from fraction data t.

When difference pitch data dTm is subtracted to be "73" and order data m reaches "21", fraction data t is "17". Since fraction data "17" is smaller than next difference pitch data dTm (m=21) "70", the flow advances to step S193. A calculation $K=K0+12\times OCT+(m+t/dTm)/2=57.0+12\times(-2-)+(21+17/70)/2=43.62$ is performed to obtain updated tone pitch code K. This tone pitch is slightly higher than $G_1$#.

As described above, by using only difference pitch data dTm for one octave, i.e., an interval of $A_3$ to $A_4$, stored in the pitch data table, tone pitch data of other octaves can be obtained.

If extracted pitch data T is smaller than half reference pitch data T0/2 "2262.5", in steps S185 to S187, extracted pitch data T is multiplied with $2^n$ (n=1, 2, 3, . . . ) until extracted pitch data T is larger than "2262.5". Thereafter, the above-mentioned operations in steps S188 to S193 are performed to obtain tone pitch data K.

Consequently, in steps S181 to S187, microcomputer MCP multiplies extracted pitch data T with $2^n$ (n=. . . , −2, −1, 0, 1, 2, . . . ) to obtain extracted pitch data T which fall within the range of the pitch data stored in the pitch data table. Therefore, octave value OCT which is the n value is obtained, and a note name can be obtained in accordance with a correspondence between the fraction data less than one octave in extracted pitch data T and sum data of difference pitch data dTm, in steps S188 to S192.

In the above embodiment, only difference pitch data dTm and order data m in the right half in FIG. 19, reference tone pitch data K0 "57.0", and pitch data T0 "4525" are stored in the pitch data table. However, only tone pitch data K and pitch data T in the left half in FIG. 19 may be stored as pitch data T in the pitch data table. When only tone pitch data K and pitch data T are stored in the table, steps S188 and S189 are omitted, and it is determined in step S190 if extracted pitch data T obtained by multiplications with $2^n$ (n=. . . , −2, −1, 0, 1, 2, . . . ) in steps S183 and S186 is smaller than stored pitch data of tone pitches in the pitch data table. In step S191, a read address of the pitch data table is incremented by 1. The processing in step S192 is not changed. Before tone pitch calculation processing in step S193, the difference between extracted pitch data T and pitch data immediately before a read operation of the pitch data table is represented by "t". The difference between the pitch data in the pitch data table and pitch data of the next address is represented by "dTm".

When only difference pitch data dTm, order data m, reference tone pitch data K0 "57.0", and pitch data T0 "4525" are stored in the pitch data table, since the numbers of figures of difference pitch data dTm and order data m are smaller than those of tone pitch data K and pitch data T, a memory capacity can be effectively saved. However, even if tone pitch data K and pitch data T are additionally stored, the memory capacity can be similarly saved as compared with the conventional case wherein all pitch data for all octaves are stored.

Although a tone pitch is indicated by a serial number in the above embodiment, it may be represented by an octave, a scale name (note code), and data for a tone pitch having a semitone interval or less, and other representation forms may be applied.

In addition, although the pitch data is arranged in units of 50 cent (half of the semitone) in the above embodiment, the pitch data may be arranged in units of 100 cent (every semitone). The pitch data may be further divided into smaller units and such data of one or more octaves may be arranged.

As described above, corresponding tone pitch codes can be obtained from period data K. When the processing in STEP3 is performed in FIG. 9, the tone pitch code has a semitone interval or more (S312), and the tone pitch at tone generation is chromatically designated.

If NO in step S30 in FIG. 9 (when a zero-crossing point succeeding a peak having an identical polarity is detected), the flow advances to step S303. It is determined in step S303 if preceding peak value AMP (b)<current peak value c. If YES in step S303, the flow advances to step S304. In step S304, current peak value c is set as preceding peak value AMP (b), larger one of velocity VEL and value c of register C is set as velocity VEL. If NO in steps S303, S35, S36, S37, and S39, the flow returns to the main routine (RET).

Figure 17:
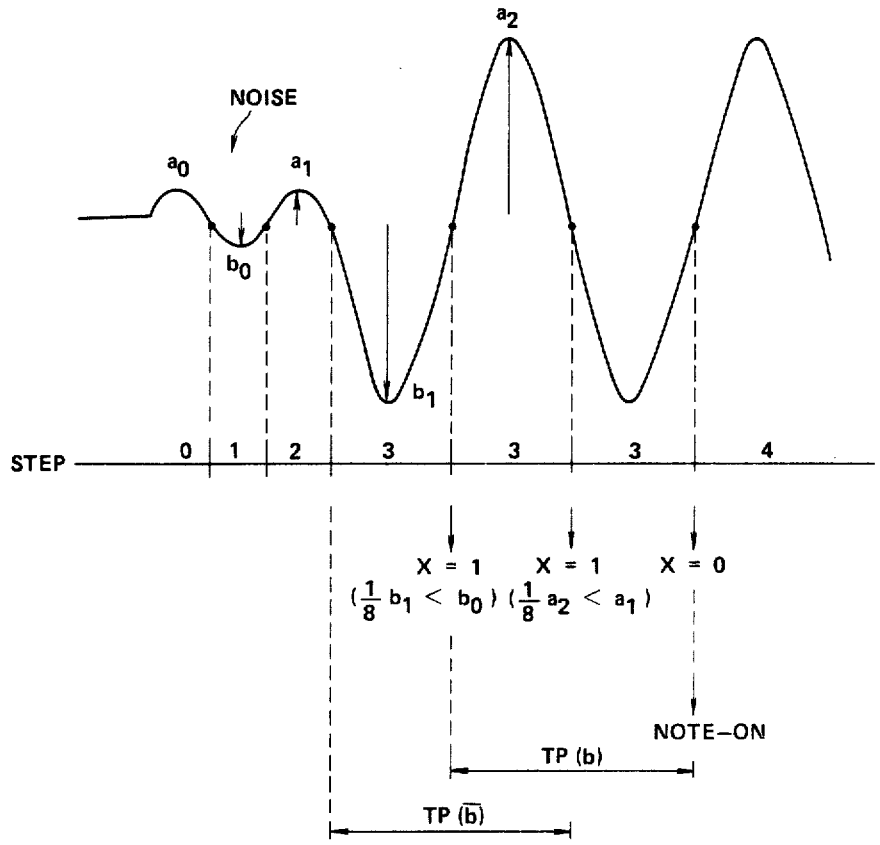
FIG. 17 is a timing chart showing operations from STEP0 to STEP4 when an waveform input including a noise signal is supplied.

FIG. 17 is a timing chart showing a case when X=1, i.e., an abnormal state in step S31. If $(\frac{1}{8})b1<b0$ and $(\frac{1}{2})a2<al$, the conditions are not satisfied, and therefore X=1.

More specifically, first three wave peaks (a0, b0, and al) in FIG. 17 are caused by noise. If these noise periods are detected and the start of tone generation is designated, a strange tone is undesirably generated. In step S31, a large change in peak value is detected, and X=1 is set to obtain NO in step S35. After a normal waveform is detected in step S31, the start of tone generation is designated.

In FIG. 17, when TP (b)≈TP ($\bar{b}$) is detected, a note-on operation is performed.

In STEP3 as described above (flow from STEP3 to STEP4 in FIG. 11), the following operations are performed. That is, MT=1≠b, AMP (0)←c, max[VEL, c]→VEL, MT←b=0, TP (0)→[t−TFN (0)], TFN (0)←t, TTP+TP (0), TFR←TFN (1), TF←t, HNC←0, ONF←2, TTU←0 (MIN), TTW←MAX, and AMRLl←0 are performed, and further note-on operation is executed if condition TP (0)≈TP (1). In STEP3, in response to an appropriate waveform input, generation of a musical tone having a chromatic tone pitch in accordance with the extracted pitch is started. As is apparent from FIG. 11, tone generation is designated to sound source SS after period detection is started and about 1.5 periods have elapsed. As described above, if the above conditions are not satisfied, tone generation is further delayed.

Figure 10:
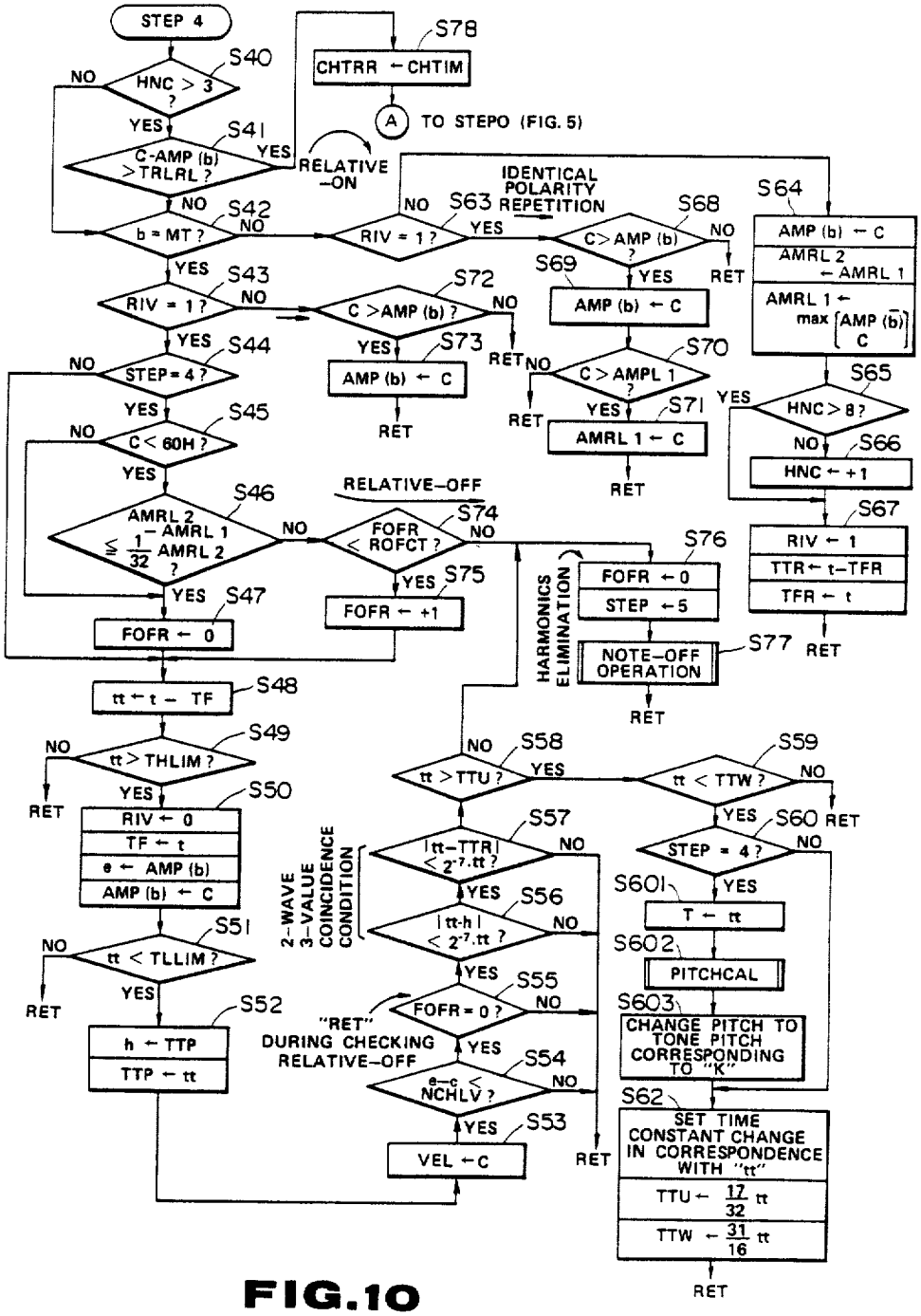
FIG. 10 is a flow chart showing subroutine STEP4 corresponding to processing in step M9 of the main routine in FIG. 4.

FIG. 10 is a flow chart of STEP4 represented by M9 in FIG. 4. In FIG. 10, route ① for performing only pitch extraction and route ② for performing actual pitch updating are available. First, route ① shown in steps S40, S41, S42, and S63 to S67 will be described below. In step S40, it is determined whether waveform number counter HNC>3. If YES in step S40, the flow advances to step S41. It is determined in step S41 if relative-on threshold value TRLRL<[current peak value c—preceding peak value AMP (b)]. If NO in step S41, the flow advances to step S42. It is determined in step S42 whether current positive/negative flag b=flag MT, i.e., whether the current side is pitch updating side or not. If YES in step S42, the flow advances to step S43.

In an initial state, since waveform number counter HNC is 0 (S301 in FIG. 9), NO is obtained in step S40, and the flow advances to step S42. For example, in the waveform input in FIG. 11, since b=1 and MT=0, the flow advances from step S42 to step S63.

In order to check that peaks having identical polarities are sequentially input (if identical polarity repetition occurs), it is determined in step S63 if register RIV=1. If YES in step S63, the flow advances to step S68. If NO (when the identical polarity repetition does not occur) in step S63, the flow advances to step S64, and the following operations are performed in step S64. That is, in step S64, current peak value c is input as preceding peak value AMP (b), preceding amplitude value AMRL1 is input as second preceding amplitude value AMRL2 for relative-off processing. In this case, the content of AMRL1 is 0 (S30 in STEP3). In addition, in step S64, larger one of preceding peak value AMP ($\bar{b}$) and current peak value c is input as preceding amplitude value AMRL1. In other words, a larger one of positive and negative peak values in the period is set as amplitude value AMRLl. If is determined in step S65 if waveform number counter HNC>8, and waveform number counter (zero-crossing counter not in the pitch updating side) HNC is incremented by 1.

Therefore, the upper limit of waveform number counter HNC is 9. After the processing in step S65 or S66 is performed, the flow advances to step S67. In step S67, register RIV is set to be 1. The content of time memory register TFR is subtracted from current zero-crossing time, and the obtained value is input to period register TTR. This period register TTR indicates period data shown in FIG. 11. Current zero-crossing time t is saved in time memory register TFR, and thereafter the flow returns to the main routine (RET).

If YES in step S63, the flow advances to step S68, and it is checked if current peak value c>preceding peak value AMP (b). If YES in step S68, the flow advances to step S69. In step S69, preceding peak value AMP (b) is updated to current peak value c, and the flow advances to step S70. It is determined in step S70 if current peak value c>preceding amplitude value AMRL1. If YES in step S70, the flow advances to step S71. In step S71, current peak value c is input as preceding amplitude value AMRL1.

If NO in step S68, the flow immediately returns to the main routine. Therefore, only when the peak value of the updated input waveform is large, the amplitude value of the updated waveform is stored. (In this case, it is regarded that the peak of a harmonic overtone is not picked up.)

If NO in step S70 and when the processing in step S71 is completed, the flow similarly returns to the main routine.

As described above, according to the embodiment shown in FIG. 11, the following operations are performed in route ①. That is, MT=0≠b, RIV=0, AMP (1)←c, AMRL2←AMRL1, AMRL1←max[AMP (0), c], HNC←(HNC+1)=1, RIV←1, TTR←(t−TFR), TFR←t are performed. Therefore, in period register TTR, the difference between time data from the preceding zero-crossing point succeeding the peak having an identical polarity (flow from STEP 2 to STEP3) to the current zero-crossing point, i.e., period data, can be obtained. The flow returns to the main routine, and waits for the next zero-crossing interruption.

The case where the flow advances to route ② shown in steps S40 to S62 will be described below. Since waveform number counter HNC=1 (S66), the flow advances from step S40 to step S42. As shown in FIG. 11, since MT=0 and b=0, YES is obtained in step S42, and the flow advances to step S43. It is determined in step S43 if register RIV=1. Since register RIV is already set to be 1 (S67) in route ①, YES is obtained in step S43, and the flow advances to step S44.

It is checked in step S44 if register STEP=4. If YES in step S44, the flow advances to step S45. It is determined in step S45 if current peak value c<60H (H represents the hexadecimal notation). Since the peak value is large, YES is obtained in step S45, and the flow advances to step S46. It is determined in step S46 if [(second preceding amplitude value AMRL2)−(preceding amplitude value AMRL1)]≦(1/32)×(second preceding amplitude value AMRL2). If YES in step S46, the flow advances to step S47, and relative-off counter FOFR is set to be 0. This relative-off processing will be described later. In step S48, a period calculation is performed. More specifically, (current zero-crossing time t−preceding zero-crossing time data TF) is set in register TOTO as current period data tt. Then, the flow advances to step S49. It is determined in step S49 if current frequency data tt>frequency upper limit THLIM (upper limit after the start of tone generation). If YES in step S49, the flow advances to step S50.

Frequency upper limit THLIM in step S49 is equal to an upper limit of the allowable range of frequencies during triggering (when tone generation is started) which is used in step S36 in subroutine STEP3 (therefore, the period is minimum and corresponds to a tone pitch period of a fret higher than a fret of the maximum tone by two to three semitones).

In step S50, the following operations are performed. That is, register RIV is set to be 0, and current zero-crossing time t is input as zero-crossing time data TF. In addition, preceding peak value AMP (b) is input as second preceding peak value e, and current peak value c is input as preceding peak value AMP (b).

After the operation in step S50 is completed, the flow advances to step S51. It is determined in step S51 if frequency lower limit TLLIM>current period data tt. If YES in step S51, i.e., if current period is the lower limit of a pitch extraction musical tone range during note-on operation or shorter than that, the flow advances to step S52.

In this case, frequency lower limit TLLIM is set to be, e.g., a tone pitch lower than that of an open string scale by one octave. More specifically, the allowable range is kept wide as compared with frequency lower limit TTLIM (S37) in STEP3 to cope with changes in frequencies upon operations of a tremolo arm.

Therefore, only when upper and lower limits of the frequencies fall within the allowable range, the flow advances to step S52. If not, the flow returns to the main routine from steps S49 and S51.

In step S52, period data TTP is input as second preceding extracted period data h, and current period data tt is input as preceding extracted period data TTP. In step S53, current peak value c is written in velocity VEL, and the flow advances to step S54. It is determined in step S54 if no-change level NCHLV>(second preceding peak value e−current peak value c). If YES in step S54, the flow advances to step S55.

More specifically, when the difference between preceding peak value having the identical polarity (e=AMP (b)) and current peak value c is large, the difference exceeds NCHLV. At this time, if the pitch is updated on the basis of the extracted period data, a tone pitch tends to be unnaturally changed. If NO in step S54, the flow returns to the main routine without operations from step S55.

If YES in step S54, it is checked whether relative-off counter FOFR=0 or not. When relative-off processing to be described later is performed, relative-off counter FOFR is not set to be 0. In such a case, NO is obtained in step S55, and the flow returns to the main routine without pitch updating processing (S603). If YES in step S55, the flow sequentially advances to steps S56 and S57.

In steps S56 and S57, a 2-wave 3-value coincidence condition is determined. It is determined in step S56 if (current period data tt)$\times 2^{-7}$>|current period data tt)−(second preceding period data h)|. If YES in step S56, the flow advances to step S57. It is determined in step S57 if (current period data tt)$\times 2^{-7}$>|(current period data tt)−(the content of period register TTR)|. If YES in step S57, the flow advances to step S58.

More specifically, it is determined in step S56 if current period data tt (S43) in FIG. 11 substantially coincides with preceding period data h (=TTP) (S52). In step S57, it is determined if current period data tt substantially coincides with period TTR which overlaps period data tt. Note that its limited range is $2^{-7}\times$tt, and its value is changed depending on the period data. Although the value may be a permanent value, according to the technique of this embodiment, a good result can be obtained.

It is checked in succeeding step S58 if current period data tt>constant TTU. If YES in step S58, the flow advances to step S59. It is checked in step S59 if current period data tt<constant TTW. If YES in step S59, the flow advances to step S60. Note that steps S58 and S59 are executed to prevent abrupt pitch updating.

Constant TTU in step S58 is set to be 0 in step S301 in STEP3, and constant TTW is similarly set to be a MAX value. For the first time in this flow, YES can always be obtained in steps S58 and S59. Thereafter, in step S62 to be described later, (17/32) tt (period data larger by about one octave) is set as constant TTU. Similarly, (31/16) tt (period data smaller by about one octave) is set as constant TTW in step S62. Therefore, when an abrupt change into a higher octave occurs (caused when a mute operation is performed), and when a change into a lower octave occurs (caused when the peak of the waveform is missed), pitch updating is unnaturally performed. Therefore, processing is branched to prevent pitch updating.

If YES in steps S58 and S59, the flow advances to step S60. It is determined in step S60 if register step=4. If YES in step S60, the flow advances to step S601, and period data tt is set to register T, thus obtaining a tone pitch code in step S602. In step S602, subroutine PITCHCAL (FIG. 18) for obtaining a tone pitch code in the same manner as in the above-mentioned step S311 is executed.

As a result, tone pitch code K including a tone pitch code having an interval less than a semitone interval can be obtained. In step S603, pitch updating is designated to sound source SS using obtained tone pitch code K.

Then, the flow advances to step S62. In step S62, a time constant is changed in accordance with current period data tt, and constant TTU is updated to (17/32)×current period data tt. In addition, constant TTW is updated to (31/16)×current period data tt.

As will be described later, only when relative-off processing is performed, STEP=5 is obtained. At this time, the time constant is changed without pitch updating. In this operation of the time constant change, microcomputer MCP sets data based on current period data tt in a register in time constant changing controller TCC in FIG. 2. This operation has already been described.

When processing in step S62 is completed, the flow returns to the main routine. Therefore, in route ② as described above, the following operations are performed as shown in FIG. 11. That is, HNC=1, MT=0=b, RIV=1, FOFR←0, tt←(t−TF), RIV←0, TF←t, e←AMP (0), AMP (0)←c, h←TTP, TTP←tt, and VEL←c. In addition, pitch updating including updating for a tone pitch having an interval less than a semitone interval (less than 100 cent) is executed when the following conditions are satisfied.

(1) TTP≈TTR≈tt,
(2) TTU<tt<TTW, and (3) AMP (0) − c < NCHLV

Thereafter, operations TTU←(17/32)×tt, and TTW←(31/16)×tt are performed.

In route ②, therefore, pitch updating for actual sound source SS is executed. In the succeeding zero-crossing interruption, the operations of route ① are performed, and the operations of route ② are similarly performed in the succeeding zero-crossing interruption. Thus, only period is extracted in route ① (S67), and actual pitch updating (S603) and time constant change processing (S62) are performed in route ②.

In step S40 in subroutine STEP4, YES is obtained after count-up operation so that the content of waveform number counter HNC exceeds 3 in step S66 in route ①. Then, the flow advances to step S41, and relative-on condition is detected. The condition is c − AMP (b) > TRLRL. When current amplitude value is increased to be larger than threshold value TRLRL as compared with preceding amplitude value AMRLl, the above condition is satisfied. When the same string is picked again after a string operation (by the tremolo playing method), the above phenomenon occurs. In order to perform relative-on processing, the flow advances from step S41 to step S78, and period CHTIM of the maximum tone fret (e.g., 22nd fret) is set in time constant change register CHTRR of time constant changing controller TTC. Thereafter, the flow advances to step S60 in FIG. 5. After a note-off operation of the musical tone during tone generation is performed, tone generation is restarted.

By a normal performance, the flow advances to steps S40, S41, and S42. In addition, the flow advances to the above-mentioned route ① or route ②.

Figure 12:
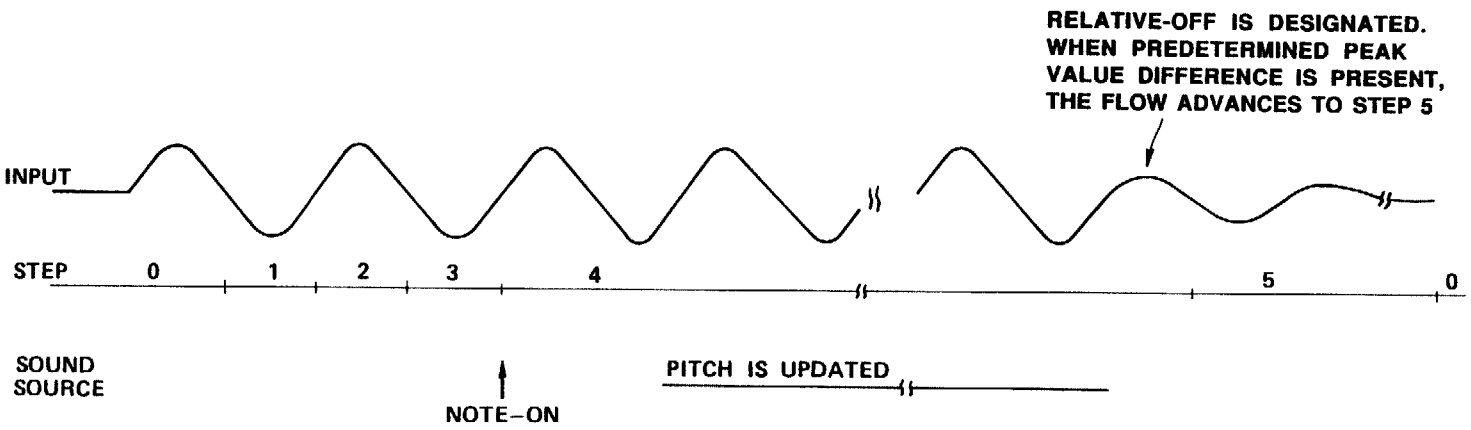
FIG. 12 is a timing chart showing operations from STEP0 to STEP5.

The relative-off processing will be described below with reference to FIGS. 12 and 13. More specifically, when the state is changed from a fret operation state to an open string state, the amplitude level of the waveform is abruptly lowered. When the difference between second preceding peak value AMRL2 and preceding peak value AMRL1 exceeds (1/32) AMRL2, the flow advances from step S46 to step S74. In addition, the flow advances from step S74 to step S75 so that relative off counter FOFR performs a count-up operation until FOFR exceeds constant ROFCT. At this time, the flow advances from step S75 to step S48, and the operations in steps S49 to S55 are performed. However, since FOFR≠0, the flow returns to the main routine without pitch updating immediately before relative-off processing.

Figure 13:
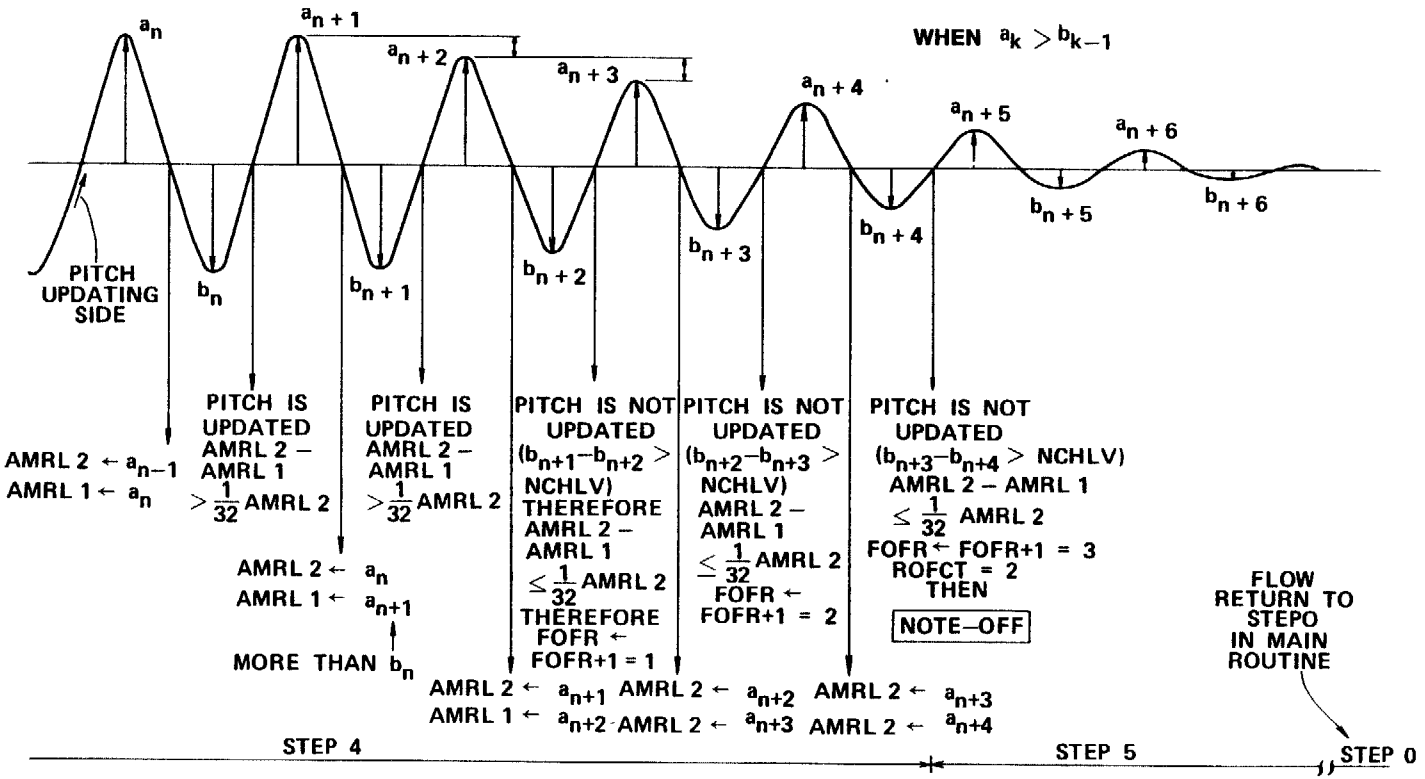
FIG. 13 is a timing chart for explaining operations when "relative-off" is detected.

If YES in step S74, i.e., when FOFR is set to be 3 (ROFCT is 2) in the embodiment in FIG. 13, the flow advances from step S74 to step S75.

If YES in step S46 for the first time, the flow advances from step S46 to step S47, and FOFR is reset. Therefore, unless the condition in step S46 is continuously satisfied the number of times designated by ROFCT, the relative-off processing is not performed. When the value of ROFCT is set to be large for a string having a high tone pitch, the relative-off processing can be performed for all the strings at predetermined time intervals.

When the flow advances from step S74 to step S76, relative-off counter FOFR is reset. Register STEP is set to be 5, and the flow advances to step S77, thus designating a note-off operation to sound source SS. When register STEP is set to be 5, pitch extraction processing is executed in the same manner as in STEP5. However, since the flow advances from step S60 to step S62 without being through steps S601 to S603, the pitch in sound source SS is not updated. However, time constant change processing is performed in accordance with the period extracted in step S62.

When register STEP is set to be 5, the relative-on processing can be accepted (S41 and S78). However, in a case other than the above state, by detecting a decrease in vibration level in the main flow in FIG. 4, register STEP is set to be 0 in step M14, thus returning to an initial state.

Note that AMRL1 and AMRL2 used in step S46 are obtained in step S64. A peak having a larger level (one of maximum and minimum peaks) in one period is set to be AMRL1 and AMRL2. In FIG. 13, maximum peak ak is always larger than minimum peak bk−1, and the differences between an+1 and an+2, an+2 and an+3, and an+3 and an+4 exceed the predetermined value.

At this time, in the operations in route ②, minimum peaks bn+1, bn+2, and bn+3 are extremely decreased. Therefore, NO is obtained in step S54, and the flow returns to the main routine and pitch is not updated.

The processing when harmonic overtones having an octave relationship, i.e., tones higher by octaves or tones lower by octaves are sequentially detected during pitch extraction will be described below.

As has been described above, when tt does not exceed TTU in step S58, i.e., when tt is smaller than TTU obtained by multiplying the preceding extracted period with 17/32, the flow advances to step S76. In other words, when a tone higher by an octave is detected, it is considered that the player's fingers are released from the designated fret to perform the muting operation, and the flow advances from step S58 to step S76 without outputting a tone higher by one octave. Then, as in the relative-off processing, tone generation of the corresponding tone is stopped by the operations in steps S76 and S77.

In step S59, when tt exceeds TTW, i.e., tt is larger than TTW obtained by multiplying the preceding extracted period with 31/16, the flow returns to the main routine without advancing to step S60.

Figure 14:
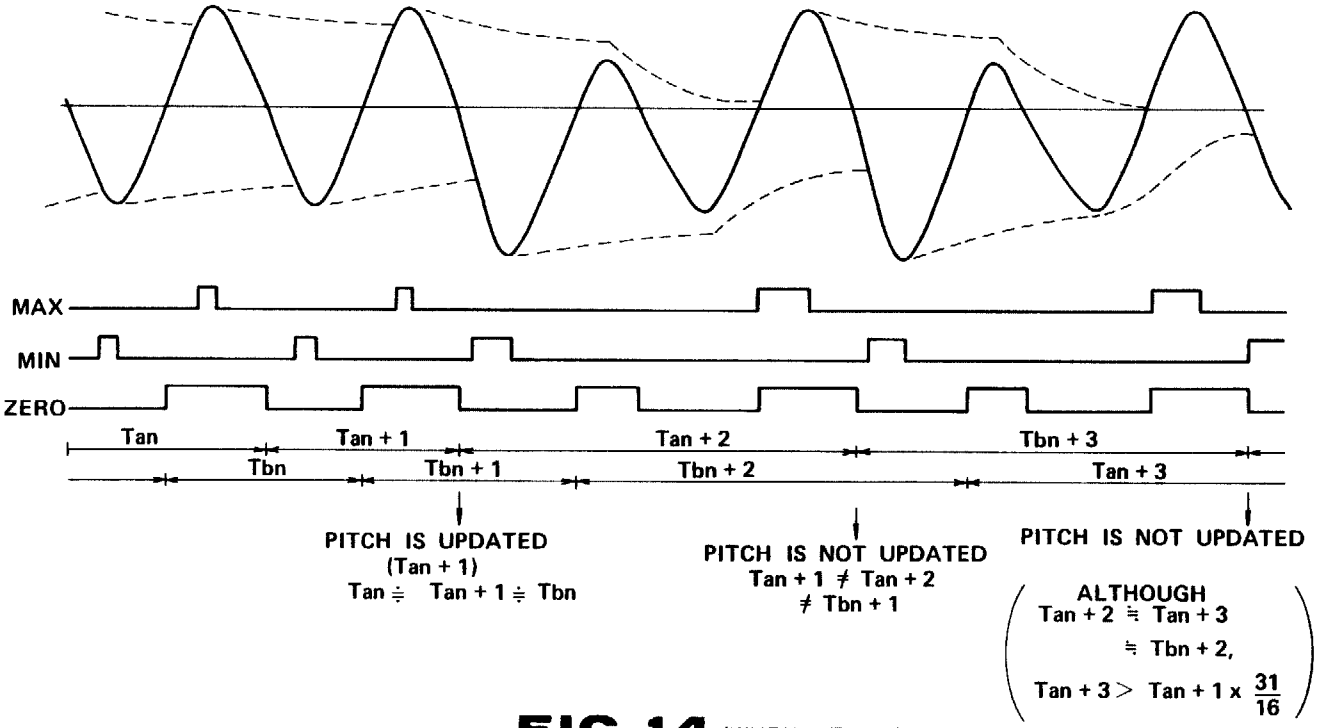
FIG. 14 is a timing chart showing operations when frequencies each lower by an octave are sequentially detected by pitch extraction.

This state is shown in FIG. 14. When the waveform near the normal note-off position is very small, the waveform is deformed by picking of other strings due to crosstalk of the hexa-pickup or resonance of the body. Therefore, e.g., an input waveform in FIG. 14 is obtained, and input waveforms lower by one octave are often continuously detected.

In such a case, if no processing is performed, a tone lower by one octave is suddenly output, thus causing an extremely unnatural state. Therefore, even if Tan+2≈Tan+3≈Tbn+2 is detected in steps S57 and S56, since Tan+3>Tan+1×(31/16), the flow returns to the main routine from step S59 without updating a pitch.

Figure 15:
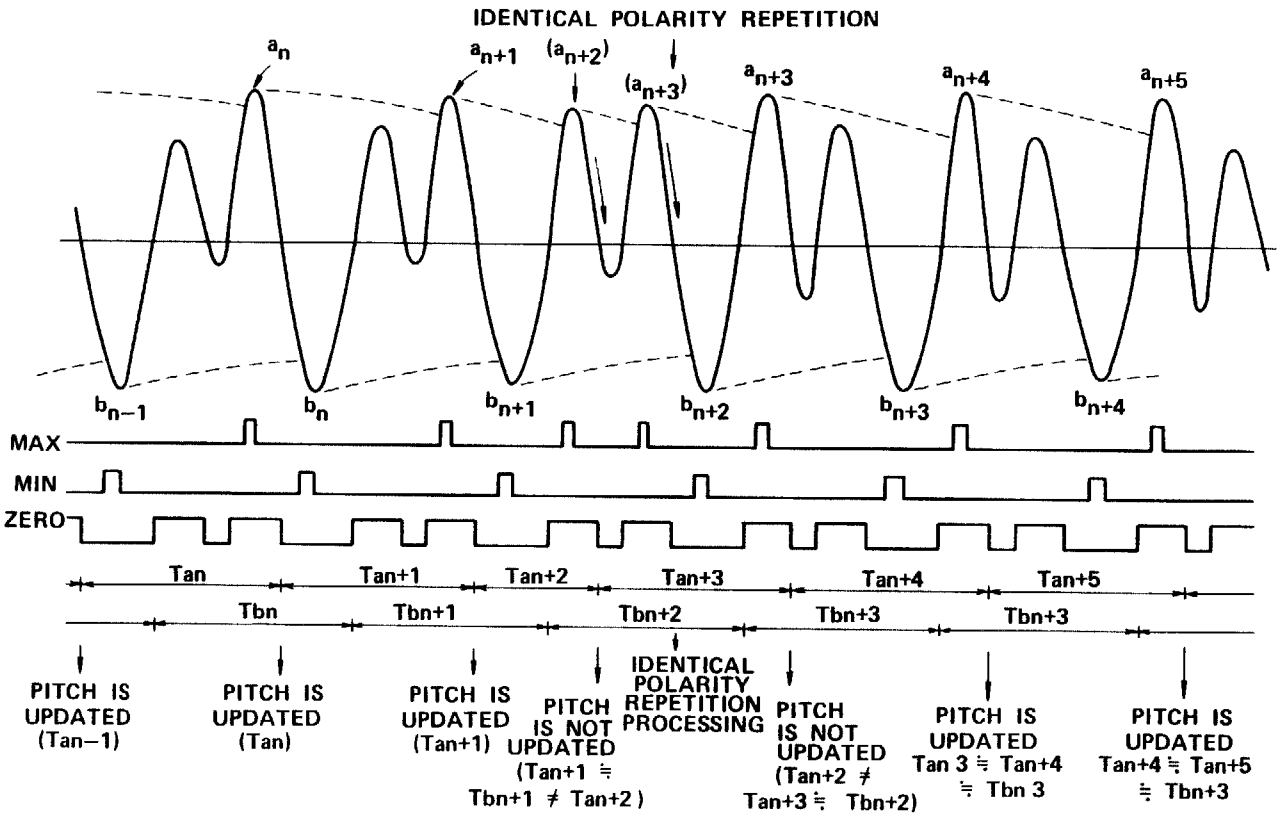
FIG. 15 is a timing chart showing operations when zero-crossing points having identical polarities successively appear and when MT=1.

A case wherein waveforms in identical polarity repetition are extracted, i.e., a case where zero-crossing points succeeding peaks having the same polarities sequentially appear will be described below. FIG. 15 shows the embodiment when MT=1. Since periods of harmonic overtone components are not given as an integer multiple of a fundamental period, the phases of the harmonic overtones are shifted and the zero-crossing point succeeding the peak having an identical polarity is detected. Therefore, incorrect pitch updating must be prevented.

In processing at the zero-crossing point in STEP4, as indicated by "identical polarity repetition" in FIG. 15, the flow advances from step S42 to step S43. In step S43, YES is obtained and the flow advances to step S72. When (an+3) is compared with (an+2) and (an+3) is larger than (an+2), YES is obtained in step S72, and the value of (an+3) is set as AMP(1). If (an+3) is smaller than (an+2), no updating is performed.

In this case, since no extracted time data is used, period data Tan+3 is not changed. Pitch updating based on the period data is not performed.

Figure 16:
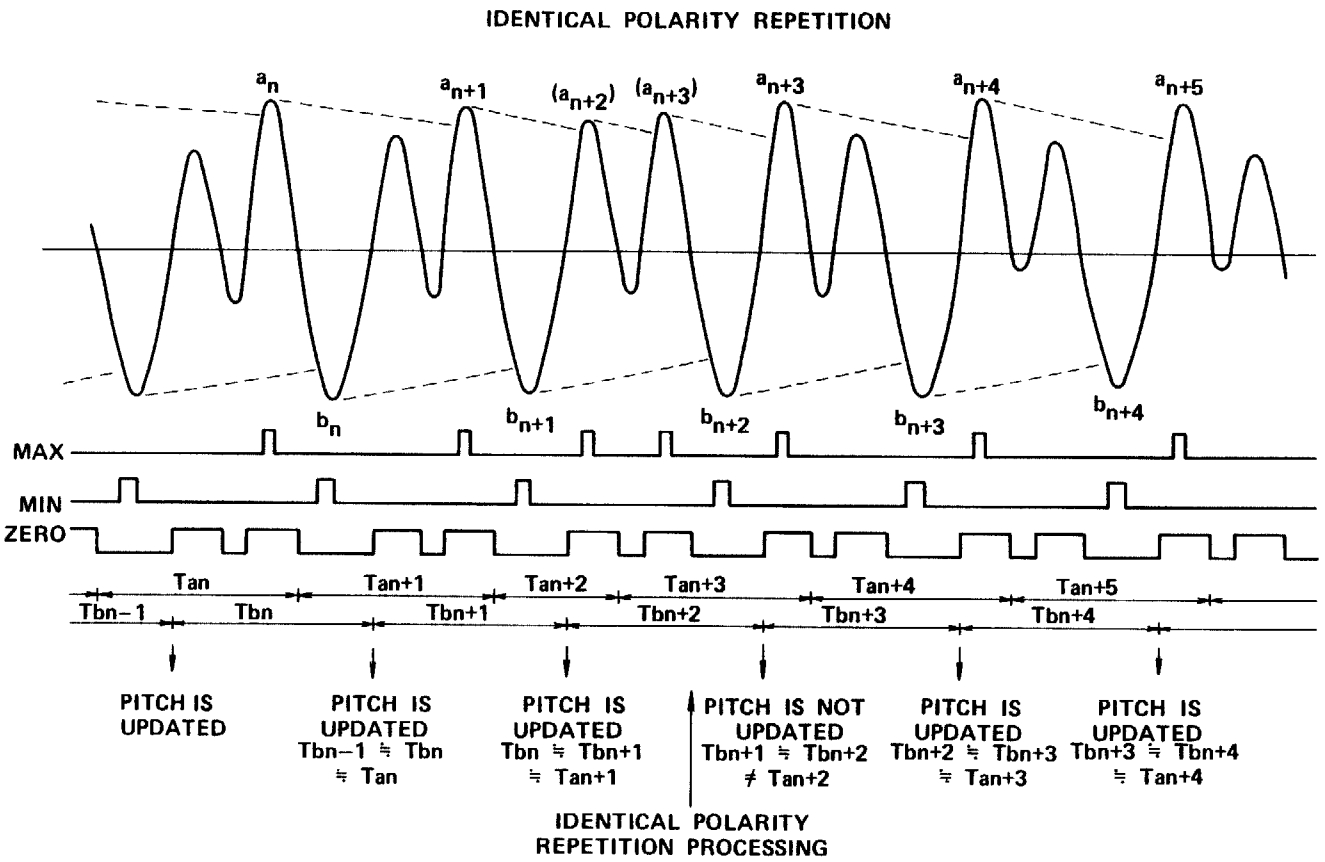
FIG. 16 is a timing chart showing operations when zero-crossing points having identical polarities successively appear and when MT=0.

Similarly, FIG. 16 shows an embodiment when the waveform has identical polarity repetition, and MT=0. In this case, at the point indicated by "identical polarity repetition" in FIG. 16, identical polarity repetition state occurs. At this time, the flow advances from step S42 to step S63, and YES is obtained in step S63. Then, the flow advances to step S68. In step S68, in this case, (an+2) is compared with (an+3). Only when (an+3) is larger than (an+2), the flow advances to step S69 and AMP (1) is updated. In this case, preceding amplitude value AMRLl is compared with current amplitude data (peak value c) in step S70. If YES in step S70, the flow advances to step S71 and current amplitude data c is set as preceding amplitude value AMRL1.

Thus, even when the waveform has identical polarity repetition due to an influence of the harmonic overtones, a pitch is not updated as long as steps S56 and S57 are not satisfied.

As described above, according to this embodiment, even in an electronic guitar with a tremolo unit, an attack having a stable musical interval can be achieved. More specifically, tone pitch code K obtained only when pitch calculations are performed in STEP3 is used as a scale tone higher by a semitone (chromatic), the interval of which is closest to a pitch extracted by rounding a tone pitch having an interval less than a semitone interval, and tone generation is started (S311 and S312).

In succeeding pitch extraction, tone pitch code K obtained in STEP4 is used without a change to control a tone pitch (S601 to S603), and a pitch having an interval less than a semitone interval can be controlled. Therefore, frequency changes with various performances such as tremolo and choking operations can be performed.

In the above embodiment, although a period is extracted in accordance with an interval between a zero-crossing point succeeding a maximum peak point and a zero-crossing point succeeding a minimum peak point, other systems may be applied, e.g., a period may be extracted in accordance with a time interval between maximum peak points or a time interval between minimum peak points. In addition, a circuit arrangement may be changed depending on the period extraction system.

In the above embodiment, although the present invention is applied to an electronic guitar (guitar synthesizer), it is not limited thereto. This invention can be applied to various instruments or apparatuses for generating an acoustic signal different from an original signal by pitch extraction.

According to the present invention as has been described above, when a starting of an input waveform signal is detected by a detecting means, a tone pitch determining means chromatically determines a tone pitch when tone generation of a musical tone output from a sound source means is started, in accordance with data for designating a semitone unit obtained in correspondence with a pitch extracted by a pitch extracting means. Therefore, when tone generation is started, a stable musical interval can be effectively obtained.

What is claimed is:

1. An input apparatus for an electronic device, comprising:

pitch extracting means for extracting a pitch period from an input waveform signal to determine a tone pitch;

pitch data generating means coupled to said pitch extracting means for generating first data for designating a tone pitch having a semitone unit, and second data for designating a tone pitch having an interval of not more than a semitone interval by using an extracted pitch period;

detecting means for detecting a starting of the input waveform signal;

tone pitch determining means for chromatically determining the tone pitch in accordance with the first data which designates a semitone unit after the second data is rounded to change the first data when the starting of the input waveform signal is detected by said detecting means; and tone pitch updating means for designating the tone pitch after the starting of the input waveform signal by the pitch extracted by said pitch extracting means on a real-time basis to update the tone pitch from a chromatic tone pitch which is designated previously.

2. An apparatus according to claim 1, wherein said pitch extracting means includes means for measuring a time interval between zero-crossing points succeeding positive or negative peaks of the input waveform signal to extract the pitch period.

3. An apparatus according to claim 1, wherein said pitch extracting means includes means for measuring a time interval between positive peaks or negative peaks of the input waveform signal .for extracting the pitch period.

4. An electronic musical instrument comprising:

pitch extracting means for extracting a pitch from an input waveform signal to determine a tone pitch;

musical tone generating means for generating a musical tone having a pitch which is designated;

starting detecting means for detecting a starting of the input waveform signal;

tone pitch determining means coupled to the musical tone generating means for chromatically determining the tone pitch when tone generation of a musical tone output from said musical tone generating means is to be started, in accordance with data which designates a semitone unit obtained in correspondence with the pitch extracted by said pitch extracting means when the starting of the input waveform signal is detected by said starting detecting means; and tone pitch updating means for designating the tone pitch after the starting of the input waveform signal by the pitch extracted by said pitch extracting means on a real-time basis to update the tone pitch from a chromatic tone pitch which is designated previously.

5. An instrument according to claim 4, wherein:

said pitch extracting means includes means for extracting a period of the input waveform signal, and, by using the extracted period, for obtaining first data for designating a tone pitch having a semitone unit and second data for designating a tone pitch having an interval of not more than a semitone interval; and said tone pitch determining means includes means for chromatically determining the tone pitch after the second data is rounded to change the first data.

6. An instrument according to claim 4, wherein said starting detecting means includes means for detecting that the positive or negative peak level of the input waveform signal exceeds a predetermined value, thereby detecting a leading edge of the input waveform signal.

7. An instrument according to claim 4, wherein said pitch extracting means includes means for measuring a time interval between zero-crossing points succeeding positive or negative peaks of the input waveform signal for extracting the pitch.

8. An instrument according to claim 5, wherein said pitch extracting means includes means for measuring a time interval between positive peaks or negative peaks of the input waveform signal for extracting the pitch.

9. An electronic string musical instrument having a plurality of strings, comprising:

pitch extracting means for extracting a pitch from an input waveform signal representing a vibration of the string;

musical tone generating means for generating a musical tone having a tone pitch which is designated;

starting detecting means for detecting a starting of the input waveform signal;

tone pitch designating means coupled to said musical tone generating means for chromatically designating the tone pitch of said musical tone produced by the musical tone generating means in accordance with the pitch extracted by said pitch extracting means when a leading edge of the input waveform signal is detected by said detecting means; and tone pitch updating means coupled to said musical tone generating means for updating the tone pitch of the musical tone produced by said musical tone generating means after the starting of the input waveform signal on a real-time basis while the tone pitch after the starting is updated to a tone pitch having an interval of less than a semitone interval by the pitch data extracted by said pitch extracting means.

10. An instrument according to claim 9, wherein:

said pitch extracting means includes means for extracting a period of the input waveform signal, and, by using the extracted period, for obtaining first data for designating a tone pitch having a semitone unit and second data for designating a tone pitch having an interval of not more than a semitone interval; and said tone pitch determining means includes means for chromatically determining the tone pitch after the second data is rounded to change the first data.

11. An input apparatus of an electronic device, comprising:

pitch extracting means for extracting pitch from an input waveform signal to determine a tone pitch;

starting detecting means for detecting a starting of the input waveform signal;

tone pitch determining means for chromatically determining the tone pitch in accordance with data which designates a semitone unit obtained in correspondence with the pitch extracted by said pitch extracting means when the starting of the input waveform signal is detected by said starting detecting means; and tone pitch updating means for designating the tone pitch after the starting of the input waveform signal by the pitch extracted by said pitch extracting means on a real-time basis to update the tone pitch from a chromatic tone pitch which is designated previously.

12. An apparatus according to claim 11, wherein said pitch extracting means includes means for measuring a time interval between zero-crossing points succeeding positive or negative peaks of the input waveform signal for extracting the pitch.

13. An apparatus according to claim 11, wherein said pitch extracting means includes means for measuring a time interval between positive peaks or negative peaks of the input waveform signal from extracting the pitch.

* * * * *